US011809131B2

(12) United States Patent
Kamae et al.

(10) Patent No.: US 11,809,131 B2
(45) Date of Patent: Nov. 7, 2023

(54) TONER

(71) Applicant: CANON KABUSHIKI KAISHA, Tokyo (JP)

(72) Inventors: Kentaro Kamae, Kanagawa (JP); Takeshi Hashimoto, Ibaraki (JP); Takeshi Ohtsu, Ibaraki (JP); Hayato Ida, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 34 days.

(21) Appl. No.: 17/189,794

(22) Filed: Mar. 2, 2021

(65) Prior Publication Data

US 2021/0278775 A1 Sep. 9, 2021

(30) Foreign Application Priority Data

Mar. 5, 2020 (JP) ..... 2020-037666
Feb. 4, 2021 (JP) ..... 2021-016866

(51) Int. Cl.
*G03G 9/087* (2006.01)

(52) U.S. Cl.
CPC ..... *G03G 9/08755* (2013.01); *G03G 9/08711* (2013.01); *G03G 9/08782* (2013.01); *G03G 9/08786* (2013.01); *G03G 9/08797* (2013.01)

(58) Field of Classification Search
CPC ..... G03G 9/08755; G03G 9/08711; G03G 9/08782; G03G 9/08786
See application file for complete search history.

(56) References Cited

U.S. PATENT DOCUMENTS 8,084,174 B2 12/2011 Hasegawa et al.
8,288,069 B2 10/2012 Fujikawa et al.
8,323,726 B2 12/2012 Naka et al.
8,921,023 B2 12/2014 Baba et al.
8,927,188 B2 1/2015 Naka et al.
8,974,994 B2 3/2015 Kamae et al.
8,986,914 B2 3/2015 Fujikawa et al.
9,057,970 B2 6/2015 Ida et al.
9,058,924 B2 6/2015 Komatsu et al.
9,063,443 B2 6/2015 Ishigami et al.
9,075,328 B2 7/2015 Minagawa et al.
9,152,088 B1 10/2015 Kobori et al.
9,348,247 B2 5/2016 Ida et al.
9,348,253 B2 5/2016 Kanno et al.
9,372,420 B2 6/2016 Mizo et al.
9,417,540 B2 8/2016 Hashimoto et al.
9,436,112 B2 9/2016 Iwasaki et al.
9,540,483 B2 1/2017 Ida et al.
9,651,883 B2 5/2017 Hama et al.
9,665,021 B2 5/2017 Ohtsu et al.
9,665,023 B2 5/2017 Kamae et al.
9,665,026 B2 5/2017 Iwasaki et al.
9,671,707 B2 6/2017 Minagawa et al.
9,696,644 B2 7/2017 Ida et al.
9,897,934 B2 2/2018 Tamura et al.
9,915,885 B2 3/2018 Katsumata et al.
9,969,834 B2 5/2018 Ohtsu et al.
10,012,918 B2 7/2018 Ishigami et al.
10,012,920 B2 7/2018 Shibata et al.
10,012,921 B2 7/2018 Kamae et al.
10,036,970 B2 7/2018 Kanno et al.
10,078,281 B2 9/2018 Ida et al.
10,082,743 B2 9/2018 Hama et al.
(Continued)

FOREIGN PATENT DOCUMENTS

JP 2016197207 A 11/2016
JP 2018156074 A * 10/2018
JP 2018156074 A 10/2018

OTHER PUBLICATIONS

English machine translation of the description of JP2018156074A (Year: 2022).*
Fedors, "A Method for Estimating Both the Solubility Parameters and Molar Volumes of Liquids", Pol. Eng. Sci., vol. 14, No. 2 (1974) 147-54.
U.S. Appl. No. 17/116,402, Takeshi Hashimoto, filed Dec. 9, 2020.
U.S. Appl. No. 17/117,444, Ichiro Kanno, filed Dec. 10, 2020.
U.S. Appl. No. 17/117,883, Ichiro Kanno, filed Dec. 10, 2020.
(Continued)

*Primary Examiner* — Peter L Vajda
*Assistant Examiner* — Boone Alexander Evans
(74) *Attorney, Agent, or Firm* — VENABLE LLP

(57) ABSTRACT

A toner comprising a toner particle that contains a binder resin and a wax, wherein the binder resin contains an amorphous polyester resin, a polymer A, and a component B, a content of the amorphous polyester resin in the binder resin is at least 50.0 mass %, the polymer A has first monomer units represented by Formula (C) below and second monomer units, $R_{Z3}$ represents a hydrogen atom or a methyl group, R represents a C18 to C36 alkyl group, a content ratio of the first monomer units in the polymer A is from 5.0 mol % to 60.0 mol %, an SP value of the second monomer units is at least 21.00, a content of the polymer A in the binder resin is from 0.10 mass % to 10.00 mass %, and SP values of the amorphous polyester resin, the polymer A, the component B and the wax satisfy specific relationships.

(C)

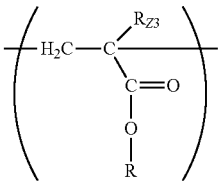

7 Claims, No Drawings

(56) References Cited

U.S. PATENT DOCUMENTS

| | | | |
|---|---|---|---|
| 10,088,765 | B2 | 10/2018 | Miyakai et al. |
| 10,133,201 | B2 | 11/2018 | Kamae et al. |
| 10,146,146 | B2 | 12/2018 | Komatsu et al. |
| 10,175,595 | B2 | 1/2019 | Onozaki et al. |
| 10,197,936 | B2 | 2/2019 | Onozaki et al. |
| 10,203,619 | B2 | 2/2019 | Yamashita et al. |
| 10,216,108 | B2 | 2/2019 | Iwasaki et al. |
| 10,228,629 | B2 | 3/2019 | Tamura et al. |
| 10,234,777 | B2 | 3/2019 | Ohtsu et al. |
| 10,274,851 | B2 | 4/2019 | Hashimoto et al. |
| 10,353,312 | B2 | 7/2019 | Kamae et al. |
| 10,401,748 | B2 | 9/2019 | Hashimoto et al. |
| 10,423,086 | B2 | 9/2019 | Hama et al. |
| 10,423,090 | B2 | 9/2019 | Ohtsu et al. |
| 10,451,986 | B2 | 10/2019 | Sano et al. |
| 10,451,990 | B2 | 10/2019 | Kamae et al. |
| 10,474,049 | B2 | 11/2019 | Onozaki et al. |
| 10,514,624 | B2 | 12/2019 | Tamura et al. |
| 10,564,560 | B2 | 2/2020 | Onozaki et al. |
| 10,599,060 | B2 | 3/2020 | Kanno et al. |
| 10,642,178 | B2 | 5/2020 | Yamashita et al. |
| 10,656,545 | B2 | 5/2020 | Kamae et al. |
| 10,775,710 | B1 | 9/2020 | Kamae et al. |
| 10,859,931 | B2 | 12/2020 | Hashimoto et al. |
| 10,859,935 | B2 | 12/2020 | Ohtsu et al. |
| 10,877,386 | B2 | 12/2020 | Murayama et al. |
| 10,969,705 | B2 | 4/2021 | Shirayama et al. |
| 2009/0233212 | A1 | 9/2009 | Fujikawa et al. |
| 2010/0143837 | A1* | 6/2010 | Klier ..... G03G 9/0833 430/114 |
| 2013/0108955 | A1 | 5/2013 | Shibata et al. |
| 2013/0244159 | A1 | 9/2013 | Ishigami et al. |
| 2013/0288173 | A1 | 10/2013 | Hashimoto et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2015/0099227 | A1 | 4/2015 | Ida et al. |
| 2016/0109820 | A1 | 4/2016 | Hashimoto et al. |
| 2016/0187795 | A1* | 6/2016 | Saitoh ..... G03G 9/08764 430/105 |
| 2016/0209769 | A1* | 7/2016 | Okubo ..... G03G 9/09733 |
| 2018/0275540 | A1 | 9/2018 | Matsuo et al. |
| 2018/0314176 | A1 | 11/2018 | Ikeda et al. |
| 2020/0073263 | A1 | 3/2020 | Hama et al. |
| 2020/0272068 | A1 | 8/2020 | Ochi et al. |
| 2020/0301301 | A1 | 9/2020 | Chimoto et al. |
| 2021/0063903 | A1 | 3/2021 | Shibata et al. |
| 2021/0141315 | A1 | 5/2021 | Kamae et al. |

OTHER PUBLICATIONS

U.S. Appl. No. 17/118,960, Masayuki Hama, filed Dec. 11, 2020.
U.S. Appl. No. 17/188,041, Takeshi Hashimoto, filed Mar. 1, 2021.

* cited by examiner

TONER

BACKGROUND OF THE INVENTION

Field of the Invention

The present disclosure relates to a toner used, for instance, in an electrophotographic system, an electrostatic recording system, and an electrostatic printing system.

Description of the Related Art

The growing spread of electrophotographic full-color copiers in recent years has been accompanied by a demand for improvements in terms of additional performance, naturally in terms of not only higher speeds and better image quality but also energy saving, shorter recovery times from sleep mode, and compatibility with various media.

Specifically a toner superior in low-temperature fixability and allowing fixing at lower temperatures is demanded as a toner that affords energy savings, for the purpose of reducing power consumption in a fixing process.

As a toner capable of shortening the recovery time from sleep mode, a toner is demanded that exhibits superior charge retention while exhibiting little change in a charge amount through a sleep mode over a long period of time.

Moreover, heavy coated paper, which is one kind of various media, contains large amounts of inorganic fine particles, e.g., calcium carbonate, for the purpose of enhancing whiteness, and as a result, the coefficient of friction derived from rubbing between paper sheets is thus large, hence a toner that forms a fixed image peels readily off the paper. Therefore, a toner exhibiting excellent abrasion resistance is demanded such that the surface of a fixed image, from which the toner does not readily peel off even when paper sheets rub against each other, is coated with a wax, whereby a coefficient of friction can be reduced and exudation of the wax is promoted.

Japanese Patent Application Publication No. 2018-156074 proposes a toner that utilizes a crystalline polyvinyl resin, as a toner having excellent low-temperature fixability, charge retention and abrasion resistance.

Further, Japanese Patent Application Publication No. 2016-197207 proposes, as a toner superior in abrasion resistance, a toner having an alkenylsuccinic acid as a carboxylic acid component of a polyester.

SUMMARY OF THE INVENTION

The toner disclosed in Japanese Patent Application Publication No. 2018-156074 utilizes a highly hydrophobic crystalline polyvinyl resin having a sharp melt property, as a result of which the toner can bring out excellent low-temperature fixability and charge retention. Moreover, in a pencil scratching test performed thereon, a certain effect was achieved by promotion of crystallization of a crystalline resin in the fixed image. This conceivably arises from the fact that the elasticity of the toner itself in the fixed image recovered as a result of crystallization of the crystalline resin, and thus the toner became less prone to breaking.

Peeling of fixed image toner off the paper, due to rubbing between sheets paper demanded in recent years, is a phenomenon in which a toner peels off the paper but without toner breakage.

A crystalline polyvinyl resin has high affinity to waxes, and as a result exudation of the wax is suppressed, and a wax layer does not form readily on the surface of a fixed image.

Such being the case, abrasion resistance demanded in recent years is poor in some instances even when using the toner disclosed in Japanese Patent Application Publication No. 2018-156074.

In the toner disclosed in Japanese Patent Application Publication No. 2016-197207, a wax is likelier to be held on the fixed image than to migrate towards a fixing roller at the time of fixing, due to the high affinity of alkenylsuccinic acids to waxes, and as a result, certain abrasion resistance effect was achieved in several types paper such as ordinary paper.

However, exudation of wax on the fixed image surface was readily suppressed on account of the high affinity of a binder resin to the wax, and abrasion resistance was thus poor, in some instances, in heavy coated paper that is demanded in recent years.

From the above it follows that there are no toners that satisfy affording all of low-temperature fixability, charge retention and abrasion resistance. There is accordingly an urgent need for the development of a toner that exhibits excellent low-temperature fixability and charge retention, and moreover superior abrasion resistance also in a fixed image on heavy coated paper or the like.

The present disclosure provides a toner that exhibits excellent low-temperature fixability and charge retention, and exhibits excellent abrasion resistance also in a fixed image on heavy coated paper or the like.

The present disclosure relates to a toner comprising a toner particle that contains a binder resin and a wax, wherein the binder resin contains an amorphous polyester resin, a polymer A, and a component B, a content of the amorphous polyester resin is at least 50.0 mass % with respect to a total mass of the binder resin, the polymer A has first monomer units represented by Formula (C) below and second monomer units different from the first monomer units, a content ratio of the first monomer units in the polymer A is from 5.0 mol % to 60.0 nol % with respect to a total number of moles of all monomer units in the polymer A.

$SP_{A21}$ $(J/cm^3)^{0.5}$, which is an SP value of the second monomer units, is at least 21.00, a content of the polymer A is from 0.10 mass % to 10.00 mass % with respect to the total mass of the binder resin, and with $SP_P$ $(J/cm^3)^{0.5}$ being an SP value of the amorphous polyester resin.

$SP_A$ $(J/cm^3)^{0.5}$ being an SP value of the polymer A, $SP_B$ $(J/cm^3)^{0.5}$ being an SP value of the component B, and $SP_W$ $(J/cm^3)^{0.5}$ being an SP value of the wax, the $SP_P$, the $SP_A$, the $SP_B$ and the $SP_W$ satisfy Expressions (1) and (2) below:

$$0.5 \leq [(SP_P - SP_A) - (SP_A - SP_W)] \quad (1)$$

$$0.5 \leq [(SP_A - SP_W) - (SP_B - SP_A)] \quad (2).$$

(C)

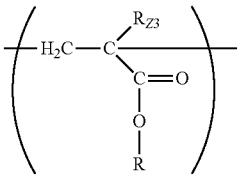

where, $R_{Z3}$ represents a hydrogen atom or a methyl group, and R represents a C18 to C36 alkyl group.

According to the present disclosure, a toner that exhibits excellent low-temperature fixability and charge retention, and exhibits excellent abrasion resistance also in a fixed image on heavy coated paper or the like, can be provided.

Further features of the present invention will become apparent from the following description of exemplary embodiments.

DESCRIPTION OF THE EMBODIMENTS

Hereafter the notations "from XX to YY" and "XX to YY" representing a numerical value range denote, unless otherwise stated, a numerical value range that includes the lower limit and the upper limit thereof, as endpoints.

In a case where numerical value ranges are described in stages, the upper limits and the lower limits of the respective numerical value ranges can be combined arbitrarily.

The term (meth)acrylic acid ester refers to an acrylic acid ester and/or methacrylic acid ester.

The term "monomer unit" denotes a form, in a polymer, resulting from reaction of a monomer substance. For instance, one unit is herein one carbon-carbon bond section in a main chain of a polymer and that results from polymerization of a vinyl-based monomer. The vinyl-based monomer can be represented by Formula (Z) below.

(Z)

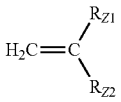

In Formula (Z), $R_{Z1}$ represents a hydrogen atom or an alkyl group (preferably a C1 to C3 alkyl group, and more preferably a methyl group), and $R_{Z2}$ represents an arbitrary substituent.

The term crystalline resin denotes a resin exhibiting a distinct endothermic peak in a differential scanning calorimetry (DSC) measurement.

The inventors studied a toner superior in low-temperature fixability and charge retention, and also excellent in abrasion resistance of fixed images in for instance heavy coated paper. As a result, the inventors found that a desired toner can be obtained by imparting a specific structure to first monomer units that form a polymer A in a binder resin, and further by controlling SP value-based affinities of the above amorphous polyester resin, polymer A, component B and wax.

Specifically, it suffices to suppress intermixing of the polymer A into the wax, while facilitating intermixing of the polymer A into an amorphous polyester resin which is a main resin of a binder resin. To that end, the component B which is a compatibilizing agent is incorporated into the binder resin.

The reason why the polymer A intermixes readily into the wax is that the absolute value of a polarity difference between the polymer A and the wax is small, while the polarity difference between the amorphous polyester resin and the polymer A is larger than the polarity difference between the polymer A and the wax. The resulting effect is that the polymer A is prone to intermix stably with the wax.

As a result of diligent research, the inventors came to the conclusion that, in order to exploit the advantages of the polymer A, namely high hydrophobicity and excellent charge retention, it is not possible to make the polarity difference between the polymer A and the wax larger than the polarity difference between the amorphous polyester resin and the polymer A. That is because increasing the polarity difference between the polymer A and the wax tends to make the polymer A hydrophilic, and may result in impaired charge retention.

In the light of the above considerations, the inventors addressed then a reduction in the compatibility between the polymer A and the wax. As a result the inventors arrived at adding the component B, as a compatibilizing agent, so that the polymer A and the amorphous polyester resin intermix readily with each other, and at imparting a specific structure to first monomer units that form the polymer A, in order to allow the polymer A to readily intermix with the component B.

Specifically, by incorporating into the binder resin the component B functioning as a compatibilizing agent, and by imparting a specific structure to the first monomer units that form the polymer A, the polymer A having a specific structure intermixes as a result more readily with the component B than with the wax, while the resulting intermixed product of the polymer A and the component B intermixes readily in turn with the amorphous polyester resin.

As a result, exudation of the wax at the time of fixing is secured, even if the polymer A is present, since the polymer A and the wax undergo phase separation. The surface of the fixed image is readily covered in consequence with the wax, and the coefficient of friction is reduced, thanks to which excellent abrasion resistance is achieved.

A toner particle contains the binder resin and the wax.

The binder resin contains the amorphous polyester resin, the polymer A, and the component B.

The polymer A may be a polymer of a composition that contains a first polymerizable monomer and a second polymerizable monomer different from the first polymerizable monomer. The polymer A has first monomer units represented by Formula (C) below, and derived from the first polymerizable monomer, and second monomer units derived from the second polymerizable monomer that is different from the first polymerizable monomer.

(C)

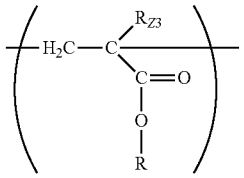

(in Formula (C), $R_{Z3}$ represents a hydrogen atom or a methyl group, and R represents a C18 to C36 alkyl group (preferably a C18 to C30 alkyl group)).

The first polymerizable monomer may be at least one selected from the group consisting of (meth)acrylic acid esters having a C18 to C36 alkyl group. The first monomer units may be monomer units represented by Formula (C) and derived from the first polymerizable monomer.

Crystallinity can be imparted to the binder resin by virtue of the fact that the (meth)acrylic acid ester has long-chain alkyl groups. As a result, the toner exhibits a sharp melt property, and excellent low-temperature fixability is obtained. Further, the (meth)acrylic acid ester is highly hydrophobic, and accordingly exhibits low hygroscopicity in high-temperature/high-humidity environments, such that excellent charge retention is obtained.

In a case by contrast where R is an alkyl group having fewer than 18 carbon atoms, the polymer having the monomer units exhibits low hydrophobicity, on account of the short chain length of the alkyl group, and exhibits high hygroscopicity in high-temperature/high-humidity environments, which results in poor charge retention. In a case where R is an alkyl group having at least 37 carbon atoms, the polymer having such monomer units has long-chain alkyl groups, and hence exhibits a high melting point, which results in poor low-temperature fixability.

Preferably, R is a C18 to C36 linear alkyl group, and more preferably a C18 to C30 linear alkyl group.

Examples of (meth)acrylic acid esters having a C18 to C36 alkyl group include (meth)acrylic acid esters having a C18 to C36 linear alkyl group (for instance stearyl (meth) acrylate, nonadecyl (meth)acrylate, eicosyl (meth)acrylate, heneicosanyl (meth)acrylate, behenyl (meth)acrylate, lignoceryl (meth)acrylate, ceryl (meth)acrylate, octacosyl (meth) acrylate, myricyl (meth)acrylate and dotriacontanyl (meth) acrylate), and (meth)acrylic acid esters having a C18 to C36 branched alkyl group (for instance 2-decyltetradecyl (meth) acrylate).

Preferred among the foregoing is at least one selected from the group consisting of (meth)acrylic acid esters having a C18 to C36 linear alkyl group, more preferably at least one selected from the group consisting of (meth)acrylic acid esters having a C18 to C30 linear alkyl group, from the viewpoint of low-temperature fixability.

More preferable among the foregoing is at least one selected from the group consisting of linear stearyl (meth) acrylate and linear behenyl (meth)acrylate, and particularly preferably at least one selected from the group consisting of linear behenyl (meth)acrylate.

The first polymerizable monomer may be used singly as one type; alternatively, at least two types thereof may be used concomitantly.

The content ratio of the first monomer units in the polymer A is from 5.0 mol % to 60.0 mol % with respect to the total number of moles of all monomer units in the polymer A.

The content ratio of the first polymerizable monomer in a polymerizable monomer composition for generating the polymer A is from 5.0 mol % to 60.0 mol % with respect to the total number of moles of all polymerizable monomers in the polymerizable monomer composition.

A sharp melt property derived from crystallinity can be brought out readily, and excellent low-temperature fixability in the toner is achieved, by virtue of the fact that the content ratio of the first monomer units in the polymer A, and the content ratio of the first polymerizable monomer in the polymerizable monomer composition for generating the polymer A, lie within the above ranges.

The content ratio of the first monomer units and the content ratio of the first polymerizable monomer are preferably from 10.0 mol % to 60.0 mol %, and more preferably from 20.0 mol % to 40.0 mol %.

In a case by contrast where the content ratio of the first monomer units or the content ratio of the first polymerizable monomer is lower than 5.0 mol %, low-temperature fixability is poor on account of the low proportion of crystalline portions.

In a case where the content ratio of the first monomer units or the content ratio of the first polymerizable monomer is higher than 60.0 mol %, the polarity of the polymer A becomes excessively low, phase separability from the wax is not readily achieved, and abrasion resistance is poor.

In a case where the polymer A has two or more types of monomer units represented by Formula (C), the content ratio of the first monomer units denotes herein the total molar ratio of the at least two types. In a case where the polymerizable monomer composition for generating the polymer A contains two or more types of (meth)acrylic acid esters having a C18 to C36 alkyl group, the content ratio of the first polymerizable monomer likewise represents the total molar ratio of the at least two types. In regard to specifying the total number of moles, number of moles are counted by regarding carbon-carbon bond (—C—C—), constituting the main chain, as one unit.

The value of $SP_{A21}$ $(J/cm^3)^{0.5}$, which is herein the SP value of the second monomer units, is at least 21.00. The above $SP_{A21}$ is preferably at least 24.00, and more preferably at least 26.00. Preferably, $SP_{A21}$ is not more than 40.00, and more preferably not more than 30.00.

The term SP value is an abbreviation of solubile parameter, the value of which serves as an indicator of solubility. The method for calculating SP values will be described further on.

The units of the SP value in the present disclosure are $(J/cm^3)^{0.5}$, but can be converted to $(cal/cm^3)^{0.5}$ units given that 1 $(cal/cm^3)^{0.5}=2.045\times10^3$ $(J/cm^3)^{0.5}$.

When the $SP_{A21}$ satisfies the above range the second monomer units exhibit high polarity, and a polarity difference arises between the first and the second monomer units. Crystallization of the first monomer units is further promoted thanks to that polarity difference, and low-temperature fixability and charge retention become further improved.

Specifically, the first monomer units are incorporated in the polymer A, whereupon crystallinity is brought about through aggregation of first monomer units to each other. Ordinarily, crystallization of the first monomer units is readily hindered when other monomer units are incorporated, so that crystallinity as a polymer is not readily brought out as a result. This tendency is pronounced when multiple types of monomer units are randomly bound to each other in one polymer molecule. It is however deemed that by using a first polymerizable monomer and a second polymerizable monomer that have a polarity difference, the first polymerizable monomer and the second polymerizable monomer can bind to each other continuously to some degree, instead of binding randomly to each other, during polymerization. As a result, blocks resulting from aggregation of first monomer units to each other are formed readily, and thus the polymer A is likely to be a block copolymer. Crystallinity can in consequence be increased, even when other monomer units are incorporated, and excellent low-temperature fixability and charge retention can be readily achieved. Further, the crystalline segments of the first monomer units have affinity to the crystalline segments of the component B, which is a below-described compatibilizing agent; as a result, the compatibility between the polymer A and the component B is readily increased, and conversely phase separability between the polymer A and the wax is obtained, thanks to which excellent abrasion resistance is achieved.

In a case by contrast where the above $SP_{A21}$ $(J/cm^3)^{0.5}$ as the SP value of the second monomer units does not satisfy the above range, the polarity difference between the polymerizable monomers that make up the polymer A is prone to be small, and the first polymerizable monomers are likely to bind to each other randomly. As a result, blocks resulting from aggregation of first monomer units to each other do not form readily, it is difficult to increase crystallinity, and charge retention may be poor.

Also, there may be fewer crystalline segments in the first monomer units, and accordingly affinity to the component B being a below-described compatibilizing agent may drop, which in turn precludes achieving phase separability between the polymer A and a wax, and abrasion resistance may be poor.

All monomer units having $SP_{A21}$ satisfying the above range come under the second monomer units derived from the above second polymerizable monomer.

In the case of polymerizable monomers with at least two types of the second polymerizable monomer, $SP_{A21}$ denotes the SP value of monomer units derived from the respective polymerizable monomers.

Herein $SP_P$ $(J/cm^3)^{0.5}$ which is the SP value of the amorphous polyester resin, $SP_A$ $(J/cm^3)^{0.5}$ which is the SP value of the polymer A, $SP_B$ $(J/cm^3)^{0.5}$ which is the SP value of the component B, and $SP_W$ $(J/cm^3)^{0.5}$ which is the SP value of the wax, satisfy Expressions (1) and (2) below.

$$0.5 \leq [(SP_P - SP_A) - (SP_A - SP_W)] \quad (1)$$

$$0.5 \leq [(SP_A - SP_W) - (SP_B - SP_A)] \quad (2)$$

The SP values of the amorphous polyester resin, the polymer A, the component B and the wax are controlled properly by satisfying Expressions (1) and (2) above, so that excellent charge retention and abrasion resistance are achieved as a result. Specifically, $(SP_P - SP_A)$ which is a polarity difference between the amorphous polyester resin and the polymer A, satisfies Expression (1) above with respect to $(SP_A - SP_W)$ which is the polarity difference between the polymer A and the wax. This indicates that the polymer A exhibits higher affinity to the wax than to the amorphous polyester resin. In turn, this entails that the polymer A has the ability of intermixing readily with the wax, and is conversely an indication of low polarity of the polymer A, which can result in excellent charge retention. Further, $(SP_A - SP_W)$ which is the polarity difference between the polymer A and the wax, satisfies Expression (2) above with respect to $(SP_B - SP_A)$ which is the polarity difference between the component B and the polymer A. This indicates that the polymer A exhibits higher affinity to the component B than the wax. As a result, compatibility between the polymer A and the component B is increased, and phase separability between the polymer A and the wax can be readily achieved, so that excellent abrasion resistance is achieved as a result.

A case where Expression (1) is not satisfied is indicative of high polarity of the polymer A; although phase separability from the wax is achieved in such an instance, charge retention is however poor. In a case where Expression (2) is not satisfied, the polarity of the component B is excessively high with respect to that of the polymer A, and accordingly the functionality of the component B as a compatibilizing agent is not fulfilled readily, and compatibility between the polymer A and the component B is more difficult to achieve. As a result, phase separability between the polymer A and the wax is not readily obtained, and abrasion resistance is accordingly poor.

Preferably the above $SP_P$, $SP_A$, $SP_K$ and $SP_W$ satisfy the relationships given in the expressions below.

$$0.6 \leq [(SP_P - SP_A) - (SP_A - SP_W)] \leq 3.0 \quad (1')$$

$$0.6 \leq [(SP_A - SP_W) - (SP_B - SP_A)] \leq 2.5 \quad (2')$$

Further, there hold preferably $SP_P - SP_A > 0$, $SP_A - SP_W > 0$ and $SP_B - SP_A > 0$.

The content of the polymer A is from 0.10 mass % to 10.00 mass % with respect to the total mass of the binder resin. In a case where the content of the polymer A satisfies the above range, the content of the polymer A can be controlled properly, and hence excellent low-temperature fixability and abrasion resistance are achieved.

Specifically, satisfying the above range is indicative of the presence of a certain amount of a crystalline resin exhibiting a sharp melt property in the binder resin, with excellent low-temperature fixability being thus obtained. Also excellent abrasion resistance is achieved, since the polymer A, which intermixes readily with the wax, is not excessively present in the binder resin.

A case by contrast where the content of the polymer A is lower than 0.10 mass % is indicative of the absence, in the binder resin, of a certain amount of a crystalline material exhibiting a sharp melt property, which translates into poor low-temperature fixability. In a case where the content of the polymer A is higher than 10.00 mass %, abrasion resistance is poor on account of the presence of the polymer A, which is then too prone to intermixing with the wax in the binder resin.

The content of the polymer A is preferably from 3.00 mass % to 10.00 mass %, and more preferably from 5.00 mass % to 10.00 mass %.

Herein $SP_P$ $(J/cm^3)^{0.5}$ and $SP_B$ $(J/cm^3)^{0.5}$ satisfy preferably Expression (3) below, and more preferably satisfy Expression (3') below.

$$1.0 \leq (SP_P - SP_B) \leq 3.0 \quad (3)$$

$$2.0 \leq (SP_P - SP_B) \leq 3.0 \quad (3')$$

By satisfying Expression (3), the polarities of the amorphous polyester resin and of the component B are properly controlled, and as a result yet superior abrasion resistance is readily achieved.

Specifically, a case where $(SP_P - SP_P)$ being the polarity difference between the amorphous polyester resin and the component B is not more than 3.0 indicates that the amorphous polyester resin and the component B do not readily undergo phase separation. As a result, the component B functions readily as a compatibilizing agent, such that phase separation between the polymer A and the wax is further promoted, with excellent abrasion resistance being achieved as a result. An instance where $(SP_P - SP_B)$ which is the polarity difference between the amorphous polyester resin and the component B is at least 1.0 indicates that the polarity of the component B is not excessive. As a result, the component B functions readily as a compatibilizing agent, such that phase separation between the polymer A and the wax is further promoted, with excellent abrasion resistance being achieved as a result.

Preferably $SP_A$ $(J/cm^3)^{0.5}$ satisfies Expression (4), and more preferably satisfies Expression (4') below.

$$18.0 \leq SP_A \leq 24.0 \quad (4)$$

$$20.0 \leq SP_A \leq 24.0 \quad (4')$$

By satisfying Expression (4) above, the polarity of the polymer A is controlled properly, and yet superior charge retention and abrasion resistance is achieved as a result. Specifically, a case where $SP_A$ is not more than 24.0 denotes that the polarity of the polymer A is not excessively high. As a result charge retention which is a characterizing feature of the polymer A is readily ensured, and yet superior charge retention is achieved. A case where $SP_A$ is at least 18.0 indicates that the polarity of the polymer A is not too low. As a result, there is not excessive intermixing with the wax, and in consequence yet superior abrasion resistance is achieved.

The content ratio of the second monomer units in the polymer A is from 20.0 mol % to 90.0 mol % with respect to the total number of moles of all monomer units in the polymer A.

The content ratio of the second polymerizable monomer in the polymerizable monomer composition for generating the polymer A is from 20.0 mol % to 90.0 mol % with respect to the total number of moles of all polymerizable monomers in the polymerizable monomer composition.

By virtue of the fact that the content ratio of the second monomer units and the content ratio of the second polymerizable monomer lie within the above ranges, the polarity of the polymer A can be controlled properly, and yet superior charge retention and abrasion resistance are achieved as a result.

Specifically, a case where the content of the second monomer units and the content ratio of the second polymerizable monomer is at least 20.0 mol % indicates that the polarity of the polymer A is not too low. In consequence excessive intermixing with the wax is unlikelier to occur, and yet better abrasion resistance is achieved as a result.

A case where the content ratio of the second monomer units and the content ratio of the second polymerizable monomer are not more than 90.0 mol % indicates that the polarity of the polymer A is not excessively high. As a result, charge retention which is a characterizing feature of the polymer A is readily ensured, and yet superior charge retention is achieved.

Further, an instance where the content ratio of the second monomer units and the content ratio of the second polymerizable monomer lie within the above ranges is indicative of the content ratio of the first monomer units, and thus of the presence of a certain amount of the first polymerizable monomer. As a result crystallinity is readily brought out, through aggregation of the first monomer units to each other, and yet superior low-temperature fixability is obtained.

From the viewpoint of charge retention and abrasion resistance, the content ratio of the second monomer units in the polymer A is more preferably from 40.0 mol % to 90.0 mol %, and yet more preferably from 40.0 mol % to 70.0 mol %, with respect to total number of moles of all monomer units in the polymer A. For similar reasons, the content ratio of the second polymerizable monomer in the polymerizable monomer composition for generating the polymer A is preferably from 40.0 mol % to 90.0 mol %, and more preferably from 40.0 mol % to 70.0 mol %, with respect to the total number of moles of all polymerizable monomers in the polymerizable monomer composition.

In a case where in the polymer A there are present two or more types of monomer units derived from a second polymerizable monomer satisfying the above $SP_{A21}$ range, the content ratio of the second monomer units denotes the total molar ratio of the at least two types. Also in a case where the composition that is used in the polymer A contains two or more types of second polymerizable monomer, the content ratio of the second polymerizable monomer denotes the total molar ratio of the at least two types.

Preferably, the second polymerizable monomer has ethylenically unsaturated bonds, and more preferably has one ethylenically unsaturated bond.

For instance, the second polymerizable monomer is preferably at least one selected from the group consisting of Formulae (A) and (B) below.

(A)

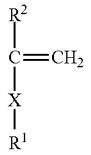

(B)

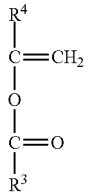

For instance the second monomer units are preferably at least one selected from the group consisting of monomer units represented by Formulae (D) and (E) below.

(D)

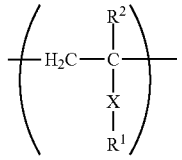

(E)

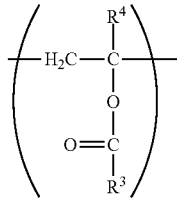

In Formula (A) and (D), X represents a single bond or a C1 to C6 alkylene group;

Further, $R^1$ represents —C≡N,

—C(=O)NH$R^{10}$ (where $R^{10}$ is a hydrogen atom or a C1 to C4 alkyl group), a hydroxy group, —COO$R^{11}$ (where $R^{11}$ is a hydrogen atom, a C1 to C6 (preferably a C1 to C4) alkyl group, or a C1 to C6 (preferably a C1 to C4) hydroxyalkyl group), —NH—C(=O)—N$(R^{13})_2$ (where the two $R^{13}$ are each independently a hydrogen atom or a C1 to C6 (preferably a C1 to C4) alkyl group), —COO$(CH_2)_2$NHCOO$R^{14}$ (where $R^{14}$ is a C1 to C4 alkyl group), or —COO$(CH_2)_2$—NH—C(=O)—N$(R^{15})_2$ (where the two $R^{15}$ are each independently a hydrogen atom or a C1 to C6 (preferably a C1 to C4) alkyl group).

Further, $R^2$ represents a hydrogen atom or a methyl group.

In Formulae (B) and (E), $R^3$ represents a C1 to C4 alkyl group, and $R^4$ represents a hydrogen atom or a methyl group.

Yet superior low-temperature fixability, charge retention and abrasion resistance are achieved through the use of at least one selected from the group consisting Formulae (A) and (B), as the second polymerizable monomer. That is because in a case where the second polymerizable monomer is at least one selected from the group consisting of Formulae (A) and (B), the second monomer units exhibit high polarity, and a polarity difference arises between the first and the second monomer units, such that crystallization of the first monomer units is further promoted by that polarity difference, and thus yet superior low-temperature fixability and charge retention are obtained.

Specifically, the first monomer units are incorporated in the polymer A, such that crystallinity is brought out through aggregation of first monomer units to each other. Ordinarily, crystallization of the first monomer units is readily hindered when other monomer units are incorporated, and crystallinity as a polymer is not readily brought out. This tendency is pronounced when multiple types of monomer units are randomly bound to each other in one polymer molecule. It is however deemed that by using a first polymerizable monomer and a second polymerizable monomer that have a polarity difference, the first polymerizable monomer and the second polymerizable monomer can bind to each other continuously to some degree, instead of binding randomly to each other, during polymerization. As a result, blocks resulting from mutual aggregation of first monomer units are formed readily, the polymer A is thus likely to be a block copolymer, crystallinity can be increased even when other monomer units are incorporated, and yet superior low-temperature fixability and charge retention are readily achieved.

Further, the crystalline segments of the first monomer units have affinity to the crystalline segments of the component B, which is a compatibilizing agent, as a result of which the compatibility between the polymer A and the component B is increased, and conversely phase separability between the polymer A and the wax is readily achieved. Yet superior abrasion resistance tends to be achieved as a result. In a case where the second polymerizable monomer is a monomer containing at least one selected from the group consisting of a nitrile group, a hydroxy group, a hydroxyalkyl group, a urea group, a urethane group and an amide group, the monomer is nonionic and accordingly exhibits high hydrophobicity, such that yet superior charge retention is obtained.

Specifically for instance the polymerizable monomers illustrated below can be used as the second polymerizable monomer.

Monomers having a nitrile group; for instance acrylonitrile and methacrylonitrile.

Monomers having a hydroxy group; for instance 2-hydroxyethyl (meth)acrylate and 2-hydroxypropyl (meth)acrylate.

Monomers having an amide group; for instance acrylamide and monomers obtained through a reaction, in accordance with a known method, of a C1 to C30 amine and a C2 to C30 carboxylic acid having an ethylenically unsaturated bond (such as acrylic acid and methacrylic acid).

Monomers having a urethane group; for instance monomers obtained through reaction, in accordance with known methods, of a C2 to C22 alcohol having an ethylenically unsaturated bond (for instance 2-hydroxyethyl methacrylate or vinyl alcohol), and a C1 to C30 isocyanate (for instance a monoisocyanate compound (such as benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethyl phenyl isocyanate, 3,5-dimethyl phenyl isocyanate and 2,6-dipropyl phenyl isocyanate); an aliphatic diisocyanate compound, for instance trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate and 2,4,4-trimethyl hexamethylene diisocyanate); an alicyclic diisocyanate compound (1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate and hydrogenated tetramethylxylylene diisocyanate); and an aromatic diisocyanate compound (for instance phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate and xylylene diisocyanate); and monomers obtained through reaction, in accordance with known methods, of a C1 to C26 alcohol (methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol or ercil alcohol) and a C2 to C30 isocyanate having an ethylenically unsaturated bond (for instance 2-isocyanatoethyl (meth)acrylate, 2-(0-[1'-methylpropylideneamino]carboxyamino)ethyl (meth)acrylate, 2-[(3,5-dimethylpyrazolyl)carbonylamino]ethyl (meth)acrylate or 1,1-(bis(meth)acryloyloxymethyl)ethyl isocyanate).

Monomers having a urea group; for instance monomers obtained through reaction, in accordance with known methods, of a C3 to C22 amine (a primary amine (for instance n-butyl amine, t-butyl amine, propyl amine or isopropyl amine), a secondary amine (for instance di-n-ethyl amine, di-n-propyl amine or di-n-butyl amine), aniline, cyclohexylamine or the like), with a C2 to C30 isocyanate having an ethylenically unsaturated bond.

Monomers having a carboxy group; for instance methacrylic acid, acrylic acid and 2-carboxyethyl (meth)acrylate.

Among the foregoing there is preferably used a monomer having a nitrile group, a hydroxy group, a hydroxyalkyl group, a urea group, a urethane group or an amide group. More preferably, the second polymerizable monomer is a monomer having an ethylenically unsaturated bond and at least one functional group selected from the group consisting of a nitrile group, a hydroxy group, a hydroxyalkyl group, a urea group, a urethane group and an amide group.

Preferred examples of the second polymerizable monomer include vinyl esters such as vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate and vinyl octylate. For instance from the viewpoint of low-temperature fixability, preferred among the foregoing are vinyl esters, since these are non-conjugated monomers, are likely to exhibit moderate reactivity towards the first polymerizable monomer, and readily increase the crystallinity of the polymer.

With $SP_{A11}$ as the SP value $(J/cm^3)^{0.5}$ of the first monomer units, preferably $SP_{A11}$ is smaller than 20.00, and is more preferably not more than 19.00, and yet more preferably not more than 18.40. The lower limit is not particularly restricted, but is preferably at least 17.00.

The polymer A may contain third monomer units derived from a third polymerizable monomer (i.e. different from the first polymerizable monomer and from the second polymerizable monomer), so long as the above-described molar ratio of the first monomer units derived from the first polymerizable monomer and the second monomer units derived from second polymerizable monomer is observed, and so long as the third monomer units do not lie within the range of the above SP value $(J/cm^3)^{0.5}$.

A monomer that does not satisfy the range of the $SP_{A21}$ $(J/cm^3)^{0.5}$, from among the monomers exemplified as the above second polymerizable monomer, can be used herein as the third polymerizable monomer.

For instance also the following monomers, not having the above nitrile group, amide group, urethane group, hydroxy group, urea group or carboxy group, can be used herein.

Styrenes such as styrene and o-methylstyrene and derivatives thereof, and (meth)acrylic acid esters such as methyl (meth)acrylate, n-butyl (meth)acrylate, t-butyl (meth)acrylate, 2-ethylhexyl (meth)acrylate and the like.

Among the foregoing, the third polymerizable monomer preferably contains at least one selected from the group consisting of styrene, methyl methacrylate and methyl acrylate. In a case for instance where the third polymerizable monomer contains styrene, the compatibility between the polymer A and the below-described component B is further increased, and yet superior abrasion resistance is achieved. Specifically, in a case where the below-described component B is a styrene acrylic resin, the styrene segments of the polymer A and the styrene segments of the component B are acted upon by π-π interactions, beyond at least the affinity derived from just the polarities alone of the polymer A and the component B, and accordingly the affinity therebetween is further increased. As a result phase separability between the polymer A and the wax is accomplished yet more readily, and excellent abrasion resistance is achieved.

For instance, the polymer A has third monomer units different from the first monomer units represented by Formula (C) and the second monomer units, the third monomer units being preferably monomer units represented by Formula (F) below.

(F)

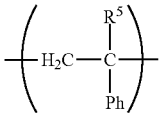

In formula (F), $R^5$ represents a hydrogen atom or a methyl group, and Ph represents a phenyl group.

The phenyl group may have a substituent.

The acid value (Av) of the polymer A is preferably not more than 30.0 mgKOH/g, more preferably not more than 20.0 mgKOH/g, from the viewpoint of improving charge retention in high-temperature-high-humidity environments.

When the acid value lies in the above range, hygroscopicity in high-temperature/high-humidity environments is low, and as a result yet superior charge retention can be brought out. The lower limit of the acid value is not particularly restricted, but is preferably at least 0 mgKOH/g.

The weight-average molecular weight (Mw) of a tetrahydrofuran (THF)-soluble fraction of the polymer A, as measured by gel permeation chromatography (GPC), is preferably from 10,000 to 200,000, and more preferably from 20,000 to 150,000. Elasticity around room temperature can be readily maintained when the weight-average molecular weight (Mw) lies in the above range.

The melting point (Tp) of the polymer A is preferably from 50° C. to 80° C., and more preferably from 53° C. to 70° C. Yet superior low-temperature fixability is brought out when the melting point of the polymer A lies within the above range.

The melting point of the polymer A can be adjusted on the basis of for instance the type and amount of the first polymerizable monomer that is used, and the type and amount of the second polymerizable monomer that is used.

The polymer A is preferably a vinyl polymer. Examples of the vinyl polymer include for instance polymers of monomers having an ethylenically unsaturated bond. The term ethylenically unsaturated bond denotes a carbon-carbon double bond capable of undergoing radical polymerization, and may be for instance that of a vinyl group, a propenyl group, an acryloyl group or a methacryloyl group.

The component B is not particularly limited so long as it can satisfy Expression (2) and Expression (3) above. The component B may be a low-molecular weight component such as a crystalline ester compound, but is preferably a resin component (high-molecular weight compound) that has high affinity to the polymer A and readily affords phase separability from the wax. In particular, the component B is a resin component having a C2 to C22 (preferably C6 to C12)hydrocarbon group (preferably an alkyl group), in order to increase affinity to the polymer A. For the purpose of polarity adjustment, the component B may contain, as a constituent component, a monomer exemplified as the above second polymerizable monomer.

The component B may be a resin component containing a graft polymer of a hydrocarbon compound and a styrene acrylic polymer. Examples of the graft polymer include polymers obtained through graft polymerization of a hydrocarbon compound onto a styrene acrylic polymer, and polymers obtained through graft polymerization of a styrene acrylic polymer onto a hydrocarbon compound.

In a case where the component B is for instance a polymer obtained through graft polymerization of a hydrocarbon compound onto a styrene acrylic polymer, the compatibility between the polymer A and the component B is further increased, and yet superior abrasion resistance is achieved as a result.

In a case where the polymer A has styrene segments, when the below-described component B contains for instance a styrene acrylic polymer affinity is further increased, in addition to the affinity derived from the polarities of the polymer A and the component B, through the action of π-π interactions in the styrene segments of the component B.

Affinity also acts between the C18 to C36 alkyl group derived from the first polymerizable monomer of the polymer A and an alkyl group derived from the hydrocarbon compound of the component B, and thus affinity is further increased as a result. In consequence phase separability between the polymer A and the wax is further improved, and yet superior abrasion resistance is achieved as a result.

The graft polymer of the hydrocarbon compound and the styrene acrylic polymer is not particularly limited so long as it is a polymer or copolymer of an unsaturated hydrocarbon where the hydrocarbon compound has one double bond, and various polyolefins can be used herein as the graft polymer. In particular, polyethylene-based and polypropylene-based polyolefins are preferably used. Specifically, the graft polymer is preferably a graft polymer of a polyolefin and a styrene acrylic polymer.

The following polymerizable monomers can be exemplified as polymerizable monomers that generate a styrene acrylic polymer.

Styrenic polymerizable monomers such as styrene, α-methylstyrene, p-methylstyrene, m-methylstyrene, p-methoxystyrene, p-hydroxystyrene, p-acetoxystyrene, vinyl toluene, ethylstyrene, phenylstyrene, benzylstyrene and the like;

alkyl esters of unsaturated carboxylic acids (the alkyl having from 1 to 17 carbon atoms) such as methyl acrylate, ethyl acrylate, butyl acrylate, 2-ethylhexyl acrylate, methyl methacrylate, ethyl methacrylate, butyl methacrylate and 2-ethylhexyl methacrylate:

vinyl ester-based polymerizable monomers such as vinyl acetate; vinyl ether-based polymerizable monomers such as vinyl methyl ether; halogen element-containing vinyl-based polymerizable monomers such as vinyl chloride; diene-based polymerizable monomers such as butadiene and isobutylene, as well as combinations of the foregoing.

The graft polymer of a hydrocarbon compound and a styrene acrylic polymer can be obtained in accordance with a known method.

Further, the component B may contain a crystalline polyester resin.

The compatibility between the polymer A and the component B is further increased, and yet superior abrasion resistance is achieved as a result, in a case where the component B contains a crystalline polyester resin.

Specifically, affinity is further increased by virtue of the fact that affinity acts also on the C18 to C36 alkyl group derived from the first polymerizable monomer of the polymer A and the alkyl groups derived from the aliphatic diol of the component B and the aliphatic dicarboxylic acid.

In consequence phase separability between the polymer A and the wax is further improved, and yet superior abrasion resistance is achieved as a result.

The crystalline polyester resin is preferably a polycondensate of a composition that contains an alcohol component containing at least 50 mass % of a C2 to C22 aliphatic diol and an acid component containing at least 50 mass % of a C2 to C22 aliphatic dicarboxylic acid.

The C2 to C22 (more preferably C6 to C12) aliphatic diol is not particularly limited, but is preferably a chain (more preferably a linear) aliphatic diol.

Examples thereof include for instance ethylene glycol, diethylene glycol, triethylene glycol, 1,2-propanediol, 1,3-propanediol, dipropylene glycol, 4-butanediol, 1,4-butadiene glycol, tetramethylene glycol, pentamethylene glycol, hexamethylene glycol, octamethylene glycol, nonamethylene glycol, decamethylene glycol and neopentyl glycol.

Preferred among the foregoing are linear aliphatic diols such as 1,6-hexanediol, as well as α,ω-diols.

Preferably at least 50 mass %, and more preferably at least 70 mass % of the above alcohol component is an alcohol selected from among C2 to C22 aliphatic diols.

The C2 to C22 (more preferably C6 to C12) aliphatic dicarboxylic acid is not particularly limited, but is preferably a chain (more preferably a linear) aliphatic dicarboxylic acid Concrete examples thereof include oxalic acid, malonic acid, succinic acid, glutaric acid, adipic acid, pimelic acid, suberic acid, glutaconic acid, azelaic acid, sebacic acid, nonandicarboxylic acid, decandicarboxylic acid, undecandicarboxylic acid, dodecandicarboxylic acid, maleic acid, fumaric acid, mesaconic acid, citraconic acid and itaconic acid, as well as hydrolysis products of acid anhydrides or lower alkyl esters of the foregoing.

Preferably at least 50 mass %, and more preferably at least 70 mass % of the carboxylic acid component is a carboxylic acid selected from among C2 to C22 aliphatic dicarboxylic acids.

The crystalline polyester resin can be produced in accordance with an ordinary polyester synthesis method. For instance a carboxylic acid monomer and an alcohol monomer described above can be subjected to an esterification reaction or transesterification reaction, followed by a condensation polymerization reaction in accordance with an ordinary method, under reduced pressure or under introduction of nitrogen gas, so that a crystalline polyester resin can be obtained as a result. A desired crystalline polyester resin can subsequently be obtained through addition of the above aliphatic compound, with an esterification reaction.

The esterification or transesterification reaction can be conducted, as the case may require, using an ordinary esterification catalyst or transesterification catalyst such as sulfuric acid, titanium butoxide, dibutyltin oxide, manganese acetate or magnesium acetate.

Further, the condensation polymerization reaction can be carried out using an ordinary polymerization catalyst, for example, a known catalyst such as titanium butoxide, dibutyltin oxide, tin acetate, zinc acetate, tin disulfide, antimony trioxide or germanium dioxide. The polymerization temperature and the amount of catalyst are not particularly limited, and may be established as appropriate.

Preferably, the content of the component B is from 0.10 mass % to 10.00 mass % with respect to the total mass of the binder resin. The content of the component B is more preferably from 3.00 mass % to 10.00 mass %, and yet more preferably from 5.00 mass % to 10.00 mass %, with respect to the total mass of the binder resin.

When the content of the component B satisfies the above ranges, the component B is controlled to a proper amount, and excellent abrasion resistance is achieved as a result. Specifically, when the content of the component B lies in the above ranges, the amount component B necessary for intermixing with the polymer A is ensured, compatibility between the polymer A and the component B is further increased, and phase separability between the polymer A and the wax is further improved, so that yet superior abrasion resistance is achieved as a result.

The binder resin contains an amorphous polyester resin. The content of the amorphous polyester resin is at least 50.0 mass % with respect to the total mass of the binder resin. The content of the amorphous polyester resin in the binder resin is preferably at least 80.0 mass %, and more preferably at least 85.0 mass %. The content is preferably not more than 95.0 mass %.

Examples of polymerizable monomers that generate an amorphous polyester resin include polyhydric alcohols (at least divalent- or trivalent-alcohols) and polyvalent carboxylic acids (at least divalent- or trivalent-carboxylic acids), as well as acid anhydrides and lower alkyl esters thereof.

The polyhydric alcohols below can be used as the polyhydric alcohol.

Bisphenol derivatives are preferred as divalent alcohols.

Examples of bisphenol derivatives include for instance polyoxypropylene(2,2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl) propane, polyoxypropylene(6)-2,2-bis(4-hydroxyphenyl) propane and the like.

Examples of other alcohol components include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropane triol, 2-methyl-1,2,4-butanetriol, trimethylol ethane, tritrimethylolpropane and 1,3,5-trihydroxymethylbenzene. These polyhydric alcohols can be used singly, or in combinations of a plurality thereof.

The polyvalent carbcoxylic acids below can be used as the polyvalent carboxylic acid.

Examples of divalent carboxylic acids include for instance maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, n-octyl succinic acid, isooctenyl succinic acid and isooctyl succinic acid, as well as anhydrides and lower alklyl esters of these acids.

Examples of at least trivalent carboxylic acids, acid anhydrides thereof and lower alkyl esters thereof include for instance 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanctricarboxylic acid, 1,3-dicarboxyl-2-methyl-2-methylenecarboxypropane, 1,2,4-cyclohexanetricarboxylic acid, tetra(methylene carboxyl)methane, 1,2,7,8-octane tetracarboxylic acid, pyromellitic acid and Empol trimer acids, as well as acid anhydrides thereof, and lower alkyl esters thereof.

Preferred among the foregoing is 1,2,4-benzenetricarboxylic acid, i.e. trimellitic acid or derivatives thereof, since these are inexpensive and afford easy reaction control. These divalent carboxylic acids and the like and at least trivalent calboxylic acids can be used singly or in combinations of a plurality thereof.

The method for producing the amorphous polyester resin is not particularly limited, and a known method can be resorted to herein. For instance, a polyhydric alcohol and a polyvalent carboxylic acid described above are simultaneously charged and are polymerized, as a result of an esteritication reaction or a transesterification reaction, and a condensation reaction, to produce a polyester resin. The polymerization temperature is not particularly limited, but lies preferably in the range from 180° C. to 290° C. For instance a polymerization catalyst such as a titanium-based catalyst, a tin-based catalyst, zinc acetate, antimony trioxide or germanium dioxide can be used in polymerization of polyesters.

Preferably, the acid value of the amorphous polyester resin is from 5 mgKOH/g to 20 mgKOH/g, from the viewpoint of charge retention in high-temperature, high-humidity environments. Preferably, the hydroxyl value of the amorphous polyester resin is from 20 mgKOH/g to 70 mgKOH/g, from the viewpoint of low-temperature fixability and storability.

The toner particle contains a wax. Examples of the wax include the following.

- Hydrocarbon waxes such as low molecular weight polyethylene, low molecular weight polypropylene, alkylene copolymers, microcrystalline wax, paraffin wax and Fischer-Tropsch wax; hydrocarbon wax oxides or block copolymers thereof, such as polyethylene oxide wax;
- waxes having a fatty acid ester as a main component, such as carnauba wax; waxes obtained by deacidifying part or the entirety of a fatty acid ester, such as deacidified carnauba wax;
- saturated linear fatty acids such as palmitic acid, stearic acid and montanic acid; unsaturated fatty acids such as brassinic acid, eleostearic acid and parinaric acid;
- saturated alcohols such as stearyl alcohol, aralkyl alcohols, behenyl alcohol, carnaubyl alcohol, ceryl alcohol and melissyl alcohol; and polyhydric alcohols such as sorbitol;
- esters of fatty acids such as palmitic acid, stearic acid, behenic acid and montanic acid with alcohols such as stearyl alcohol, aralkyl alcohols, behenic alcohol, carnaubyl alcohol, ceryl alcohol and melissyl alcohol;
- fatty acid amides such as linoleamide, oleanide and lauranmide; saturated fatty acid bisamides such as methylene bis(stearamide), ethylene bis(capramide), ethylene bis(lauramide) and hexamethylene bis (stearanmide); unsaturated fatty acid amides such as ethylene bis(oleamide), hexamethylene bis(oleamide), N,N'-dioleyladipamide and N,N'-dioleylsebacamide; aromatic bisamides such as m-xylene bis(stearamide) and N,N'-distearyl isophthalamide;
- aliphatic metal salts (generally referred to as metal soaps) such as calcium stearate, calcium laurate, zinc stearate and magnesium stearate;
- partial esterification products of fatty acids and polyhydric alcohols, such as behenic acid monoglyceride; and methyl ester compounds having a hydroxyl group obtained through hydrogenation of a vegetable oil.

Preferred among these waxes are hydrocarbon waxes such as paraffin wax and Fischer-Tropsch wax, and fatty acid ester waxes such as carnauba wax, from the viewpoint of abrasion resistance.

The content of the wax is preferably from 3 mass % to 8 mass % with respect to the total mass of the binder resin, from the viewpoint of abrasion resistance.

The toner particle may contain a colorant, as needed. Examples of the colorant include the following.

Examples of black colorants include carbon black, and colorants that are color-matched to black through the use of a yellow colorant, a magenta colorant and a cyan colorant. A pigment may be used singly as the colorant; alternatively a dye and a pigment may be used concomitantly as e colorant. Preferably a dye and a pigment are used concomitantly in terms of the image quality of a full-color image.

Examples of magenta toner pigments include the following.

C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269 and 282; C.I. Pigment Violet 19; and C.I. Vat Red 1, 2, 10, 13, 15, 23, 29 and 35.

Examples of magenta toner dyes include the following.

Oil-soluble dyes such as C.I. Solvent Red 1, 3, 8, 23, 24, 25, 27, 30, 49, 81, 82, 83, 84, 100, 109 and 121; C.I. Disperse Red 9; C.I. Solvent Violet 8, 13, 14, 21 and 27; and C.I. Disperse Violet 1.

Basic dyes such as C.I. Basic Red 1, 2, 9, 12, 13, 14, 15, 17, 18, 22, 23, 24, 27, 29, 32, 34, 35, 36, 37, 38, 39 and 40; and C.I. Basic Violet 1, 3, 7, 10, 14, 15, 21, 25, 26, 27 and 28.

Examples of cyan toner pigments include the following.

C.I. Pigment Blue 2, 3, 15:2, 15:3, 15:4, 16 and 17; C.I. Vat Blue 6; C.I. Acid Blue 45; and copper phthalocyanine pigments in which the phthalocyanine skeleton is substituted with from 1 to 5 phthalimide methyl groups.

Examples of cyan toner dyes include C.I. Solvent Blue 70.

Examples of yellow toner pigments include the following.

C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. Vat Yellow 1, 3 and 20.

Examples of the yellow toner dyes include C.I. Solvent Yellow 162.

These colorants can be used singly or in mixtures thereof, and also in a solid solution state.

The colorant is selected from the viewpoint of hue angle, chroma, lightness, light fastness, OHP transparency, and dispersibility in the toner.

The content of the colorant is preferably from 0.1 parts by mass to 30.0 parts by mass with respect to 100 parts by mass as the total amount of the resin component The toner particle may contain a charge control agent, as needed. By incorporating a charge control agent it becomes possible to stabilize charge characteristics and to control an optimal triboelectric charge quantity according to the developing system.

Known agents can be used herein as the charge control agents, and particularly preferably a metal compound of an aromatic carboxylic acid that is colorless, affords a high charging speed of the toner, and can stably hold a constant charge amount.

Examples of negative-type charge control agents include metal salicylate compounds, metal naphthoate compounds, metal dicarboxylate compounds, polymer-type compounds having sulfonic acid or a carboxylic acid in a side chain, polymer-type compounds having a sulfonate salt or sulfonic acid esterification product in a side chain, polymer-type compounds having a carboxylate salt or carboxylic acid esterification product in a side chain, boron compounds, urea compounds, silicon compounds, and calixarenes.

The charge control agent may be added internally or externally to the toner particle.

The content of the charge control agent is preferably from 0.2 parts by mass to 10.0 parts by mass, more preferably from 0.5 parts by mass to 10.0 parts by mass, with respect to 100 parts by mass of the binder resin.

The toner may contain inorganic fine particles, as needed.

The inorganic fine particles may be internally added to the toner particle, or may be mixed with the toner particle as an external additive. Examples of the inorganic fine particles include fine particles such as silica fine particles, titanium oxide fine particles, alumina fine particles, and double oxide fine particles of the foregoing. Among inorganic fine particles, silica fine particles and titanium oxide fine particles are preferred for the purpose of improving flowability and uniformizing charge.

The inorganic fine particles are preferably hydrophobized using a hydrophobizing agent such as a silane compound, silicone oil, or a mixture thereof.

The specific surface area of the inorganic fine particles as an external additive is preferably from 50 $m^2/g$ to 400 $m^2/g$, from the viewpoint of improving flowability. The specific surface area of the inorganic fine particles as an external additive is preferably from 10 $m^2/g$ to 50 $m^2/g$, in terms of improving durability stability. Inorganic fine particles having a specific surface area lying in the above range may be used in combination, in order to achieve both improved flowability and durability stability.

The content of the inorganic fine particles as an external additive is preferably from 0.1 parts by mass to 10.0 parts by mass, with respect to 100 parts by mass of the toner particle. A known mixer such as a Henschel mixer can be used for mixing the toner particle and the external additive.

The toner can be used as a single-component developer, but may also be used as a two-component developer by being mixed with a magnetic carrier, in order to further improve dot reproducibility and in order to supply stable images over long periods of time.

As the magnetic carrier there can be used generally known magnetic carriers, for instance iron oxide; metal particles of for instance iron, lithium, calcium, magnesium, nickel, copper, zinc, cobalt, manganese, chromium, and rare earths, as well as alloy particles of the foregoing, and oxide particles of the foregoing; a magnetic bodies such as ferrite; and a magnetic body-dispersed resin carrier (so-called resin carrier) containing a magnetic body and a binder resin that holds therein the magnetic body in a dispersed state.

In a case where the toner is used as a two-component developer by being mixed with a magnetic carrier, the mixing ratio of the magnetic carrier is then preferably from 2 mass % to 15 mass %, more preferably from 4 mass % to 13 mass %, as the toner concentration in the two-component developer.

The method for producing the toner particle and the toner is not particularly limited, and known methods such as pulverization, suspension polymerization, dissolution suspension, emulsification aggregation, dispersion polymerization and the like may be resorted to.

A method for producing a toner particle and toner by pulverization will be explained next.

In a starting material mixing step, materials that make up the toner particle, for instance a binder resin containing an amorphous polyester resin, the polymer A, the component B, plus a wax, and, as needed, also other components such as a colorant and a charge control agent, are weighed in predetermined amounts, and are blended and mixed.

Examples of mixing devices include a double-cone mixer, a V-type mixer, a drum-type mixer, a super mixer, a Henschel mixer, a Nauta mixer and Mechano Hybrid (by Nippon Coke & Engineering Co., Ltd.).

The mixed materials are melt-kneaded, to thereby disperse the wax and so forth in the resin component. A batch kneader such as a pressure kneader or Banbury mixer, or a continuous kneader, can be used in the melt kneading step. Single-screw and twin-screw extruders have become mainstream extruders on account of their superiority in terms of allowing for continuous production. Specific examples include KTK model twin-screw extruder (by Kobe Steel, Ltd.), TEM model twin-screw extruder (by Toshiba Machine Co., Ltd.), PCM kneader (by Ikegai Corp.), a twin-screw extruder (by KCK Co.), Ko-kneader (by Buss AG) and Kneadex (by Nippon Coke & Engineering Co., Ltd.). The resin composition obtained by melt kneading may then be rolled using for instance two rolls, and may be cooled for instance with water in a cooling step.

Next, the cooled resin composition is pulverized to the desired particle diameter in a pulverization step. In the pulverization step, the resulting product is coarsely pulverized using a pulverizer such as a crusher, hammer mill or feather mill, and is thereafter finely pulverized using for instance a Kryptron system (by Kawasaki Heavy Industries, Ltd.), Super Rotor (by Nisshin Engineering Inc.) or Turbo Mill (by Freund-Turbo Corporation), or a pulverizer using an air jet system.

This is followed as needed by classification using a sieving or classifying apparatus such as Elbow Jet (by Nittetsu Mining Co., Ltd.) which is an inertial classification system, or Turboplex (by Hosokawa Micron Corporation), TSP Separator (by Hosokawa Micron Corporation) or Faculty (by Hosokawa Micron Corporation) relying on centrifugal classification.

Further, an external additive is externally added to the surface of the toner particle, as the case may require. The method for externally adding an external additive may involve mixing a predetermined amount of various known external additives with a classified toner particle, and stirring a mixing the whole using an external addition apparatus in the form of a mixing device such as a double-cone mixer, a V-type mixer, a drum-type mixer, a super mixer, a Henschel mixer, a Nauta mixer, Mechano Hybrid (by Nippon Coke & Engineering Co., Ltd.) or Nobilta (by Hosokawa Micron Corporation).

Methods for measuring various physical properties of toner and starting materials will be described below.

Method for Separating Materials from Toner

Respective materials can be separated from the toner by exploiting differences in the solubilities, in a solvent, of the materials contained in the toner.

First separation: the toner is dissolved in methyl ethyl ketone (MEK) at 23° C., to separate a soluble fraction (amorphous polyester resin, component B) and an insoluble fraction (polymer A, wax, colorant, inorganic fine particles and so forth).

Second separation: the insoluble fraction (polymer A, wax, colorant, inorganic fine particles and so forth) obtained in the first separation is dissolved in MEK at 100° C., to separate a soluble fraction (polymer A and wax) from an insoluble fraction (colorant, inorganic fine particles and so forth).

Third separation: the soluble fraction (polymer A and wax) obtained in the second separation is dissolved in chloroform at 23° C., to separate a soluble fraction (polymer A) and an insoluble fraction (wax).

Fourth separation: the soluble fraction (amorphous polyester resin and component B) obtained in the first separation is dissolved in a mixed solution of methyl ethyl ketone (MEK) and toluene at 23° C., to separate a soluble fraction (component B) and an insoluble fraction (amorphous polyester resin).

Method for Measuring Content Ratios of Monomer Units Derived from Various (Polymerizable) Monomers in Amorphous Polyester Resin, Polymer A, Component B and Wax The content ratio of the monomer units derived from various (polymerizable) monomers in the amorphous polyester resin, the polymer A, the component B and the wax is measured by $^1$H-NMR under the following conditions.

Measuring device: FT NMR device JNM-EX400 (by JEOL Ltd.)

Measurement frequency: 400 MHz

Pulse conditions: 5.0 μs

Frequency range: 10500 Hz

Integration count: 64 times

Measurement temperature: 30° C.

Sample: a sample is prepared by placing 50 mg of a measurement sample in a sample tube having an inner diameter of 5 mm, with addition of deuterated chloroform ($CDCl_3$) as a solvent, followed by dissolution in a thermostatic bath at 40° C.

From among the peaks attributed to the constituent elements of the monomer units derived from the first polymerizable monomer, for instance for the polymer A, peaks independent from peaks attributed to constituent elements of monomer units otherwise derived are selected on the basis of the obtained $^1$H-NMR chart, and an integration value $S_1$ of the selected peaks is calculated.

From among the peaks attributed to constituent elements of monomer units derived from the second polymerizable monomer there are similarly selected peaks independent from peaks attributed to constituent elements of monomer units otherwise derived, and an integration value $S_2$ of the selected peaks is calculated.

In a case where a third polymerizable monomer is used, then from among the peaks attributed to the constituent elements of the monomer units derived from the third polymerizable monomer there are selected peaks independent from peaks attributed to constituent elements of monomer units otherwise derived, and an integration value $S_3$ of the selected peaks is calculated.

The content ratio of the monomer units derived from the first polymerizable monomer is worked out as described below using the above integration values $S_1$, $S_2$ and $S_3$. Herein $n_1$, $n_2$ and $n_3$ are the number of hydrogens among the constituent elements to which there are attributed the peaks of interest for each segment.

$$\text{Content ratio (mol \%) of monomer units derived from the first polymerizable monomer}=\{(S_1/n_1)/((S_1/n_1)+(S_2/n_2)+(S_3/n_3))\}\times 100$$

The content ratios of the monomer units derived from the second polymerizable monomer and the third polymerizable monomer are worked out in a similar way, as follows.

$$\text{Content ratio (mol \%) of monomer units derived from the second polymerizable monomer}=\{(S_2/n_2)/((S_1/n_1)+(S_2/n_2)+(S_3/n_3))\}\times 100$$

$$\text{Content ratio (mol \%) of monomer units derived from the third polymerizable monomer}=\{(S_3/n_3)/((S_1/n_1)+(S_2/n_2)+(S_3/n_3))\}\times 100$$

In a case where in the polymer A there is used a polymerizable monomer that contains no hydrogen in any constituent element other than vinyl groups, the above content ratio is calculated in the same way as in $^1$H-NMR, but herein resorting to $^{13}$C-NMR using $^{13}$C as the measurement nucleus, in a single-pulse mode.

In a case where the toner is produced by suspension polymerization, the peaks of the wax and the peaks of other resins may overlap each other, and it may not be possible to observe independent peaks. In consequence, the content ratios of monomer units derived from various polymerizable monomers in the polymer A may in some instances be impossible to calculate. In such a case a polymer A' can be similarly produced by suspension polymerization, but without using a wax and other resins, the polymer A' being then analyzed while being regarded as the polymer A.

Method for Calculating SP Values

The SP value of each polymerizable monomer, the SP value of monomer units derived from each polymerizable monomer, and the SP values of the polymer A, the component B, the amorphous polyester resin, and the wax are worked out as described below, in accordance with the calculation method proposed by Fedors.

The evaporation energy (Δei) (cal/mol) and molar volume (Δvi) ($cm^3$/mol) of atoms or atomic groups in the molecular structure of each substance above are worked out on the basis of the tables given in "Polym. Eng. Sci., 14 (2), 147-154 (1974)", where $(4.184\times\Sigma\Delta ei/\Sigma\Delta vi)^{0.5}$ is taken as the SP value $(J/cm^3)^{0.5}$.

Further, the values for monomer units such as $SP_{A21}$ and so forth are calculated in accordance with the same calculation method, for the atoms or atomic groups in the molecular structure, in a state where the double bonds of the polymerizable monomer of the respective monomer units have been cleaved through polymerization.

Specifically, to work out $SP_{A21}$ the evaporation energies of the monomer units are divided by the respective molar volumes; herein $SP_A$, $SP_B$, $SP_P$ and $SP_W$ are worked out, for each monomer unit on the basis of the evaporation energy (Δei) and molar volume (Δvi) of the respective monomer units derived from the respective constituent polymerizable monomer, and then products of (Δei) and (Δvi) and the respective molar ratios (j) for $SP_A$, $SP_B$, $SP_N$ or $SP_W$ of the respective monomer units are calculated, with the sum total of the evaporation energies of the monomer units being divided by the total sum of molar volumes, followed by the calculation given in the expression below.

$$SP=\{4.184\times(\Sigma j\times\Sigma\Delta ei)/(\Sigma j\times\Sigma\Delta vi)\}^{0.5}$$

Method for Measuring Weight-average Molecular Weight (Mw) of Amorphous Resin by Gel Permeation Chromatography (GPC)

The weight-average molecular weight (Mw) of a tetrahydrofuran (THF)-soluble fraction of the amorphous polyester resin and of the component B is measured by gel permeation chromatography (GPC), as follows.

Firstly, a sample to be measured is dissolved in tetrahydrofuran (THF) for 24 hours at room temperature. The obtained solution is then filtered through a solvent-resistant membrane filter "MYSYORI DISC" (by Tosoh Corporation) having a pore diameter of 0.2 μm, to obtain a sample solution. The sample solution is adjusted so that the concentration of the THF-soluble component is about 0.8 mass %. A measurement is performed then under the conditions below, using the sample solution.

Device: HLC8120 GPC (detector: RI) (by Tosoh Corporation)

Column: seven columns Shodex KF-801, 802, 803, 804, 805, 806 and 807 (by Showa Denko K.K.)

Eluent: tetrahydrofuran (THF)

Flow rate: 1.0 mL/min

Oven temperature: 40.0° C.

Sample injection amount: 0.10 mL

To calculate the molecular weight of the sample there is used a molecular weight calibration curve created using a standard polystyrene resin (product name "TSK STANDARD POLYSTYRENE F-850, F-450, F-288, F-128, F-80, F-40, F-20, F-10, F-4, F-2, F-1, A-5000, A-2500, A-1000 or A-500", by Tosoh Corporation).

Method for Measuring Weight-average Molecular Weight (Mw) of Crystalline Resin such as Polymer A by Gel Permeation Chromatography (GPC)

The weight-average molecular weight (Mw) of the toluene soluble fraction at 100° C. of a crystalline resin such as the polymer A is measured by gel permeation chromatography (GPC) for instance as follows.

Firstly, a sample to be measured is dissolved in toluene for 1 hour at 100° C. The obtained solution is then filtered through a solvent-resistant membrane filter "MYSYORI DISC" (by Tosoh Corporation) having a pore diameter of 0.2 μm, to obtain a sample solution. The sample solution is adjusted so that the concentration of the toluene-soluble component is about 0.1 mass %. A measurement is performed under the conditions below, using the sample solution.

Device: HLC-8121GPC/HT (by Tosoh Corporation)

Column: two columns TSKgel GMHHR-H HT (7.8 cm I.D.×30 cm) (by Tosoh Corporation)

Detector: high-temperature RI

Temperature: 135° C.

Solvent: toluene

Flow rate: 1.0 mL/min

Sample: 0.4 mL injection of 0.1 mass % sample

To calculate the molecular weight of the sample there is used a molecular weight calibration curve created utilizing a monodisperse polystyrene standard sample. The molecular weight is then calculated through polyethylene conversion in accordance with a conversion formula derived from the Mark-Houwink viscosity equation.

Method for Measuring Acid Value

The acid value is the number of mg of potassium hydroxide necessary for neutralizing the acid contained in 1 g of sample. The acid value is measured according to JIS-K 0070-1992, specifically in accordance with the following procedure.

(1) Preparation of Reagents

Herein 1.0 g of phenolphthalein is dissolved in 90 mL of ethyl alcohol (95 vol %), with addition of ion-exchanged water up to 100 mL, to obtain a phenolphthalein solution.

Then 7 g of special-grade potassium hydroxide are dissolved in 5 mL of water, and ethyl alcohol (95 vol %) is added up to 1 L. The resulting solution is placed in an alkali-resistant container, so as to preclude contact with carbon dioxide, and is allowed to stand for 3 days, followed by filtration, to yield a potassium hydroxide solution. The obtained potassium hydroxide solution is stored in an alkali-resistant container. To work out the factor of the potassium hydroxide solution, 25 mL of 0.1 mol/L hydrochloric acid are placed in an Erlenmeyer flask, several drops of the phenolphthalein solution are added, and titration is carried out using the above potassium hydroxide solution, the factor being then worked out on the basis of the amount of the potassium hydroxide solution necessary for neutralization. Hydrochloric acid produced in accordance with JIS-K 8001-1998 is used as the above 0.1 mol/L hydrochloric acid.

(2) Operation (A) Main Test

Herein 2.0 g of a pulverized sample are weighed exactly in a 200 mL-Erlenmeyer flask, followed by addition of 100 mL of a toluene/ethanol (2:1) mixed solution, and subsequent dissolution over 5 hours. A few drops of the phenolphthalein solution are added next as an indicator, and titration is performed using the above potassium hydroxide solution. The end point of the titration occurs when the light red color of the indicator persists for about 30 seconds.

(B) Blank Test

Titration is performed in the same way as above but herein no sample is used (i.e. only a mixed solution of toluene-ethanol (2:1) is used).

(3) The acid value is then calculated by plugging the obtained results into the expression below.

$$A=[(C-B)\times f\times 5.61]/S$$

In the expression, A: acid value (mgKOH/g) B: addition amount (mL) of the potassium hydroxide solution in the blank test, C: addition amount (mL) of the potassium hydroxide solution in the main test, f: factor of the potassium hydroxide solution and S: mass (g) of the sample.

Method for Measuring Hydroxyl Value

The hydroxyl value is the number of mg of potassium hydroxide necessary for neutralizing acetic acid bound to a hydroxyl group at the time of acetylation of 1 g of sample. The hydroxyl value is measured according to JIS-K 0070-1992, specifically in accordance with the following procedure.

(1) Preparation of Reagents

Herein 25 g of special-grade acetic anhydride are placed in a 100 mL volumetric flask, pyridine is added to make up a total of 100 mL, with thorough shaking, to obtain an acetylation reagent. The obtained acetylation reagent is stored in a brown bottle, so as not to come into contact with moisture, carbon dioxide and so forth.

Then 1.0 g of phenolphthalein is dissolved in 90 mL of ethyl alcohol (95 vol %), with addition of ion-exchanged water up to 100 mL, to obtain a phenolphthalein solution.

Further, 35 g of special-grade potassium hydroxide are dissolved in 20 mL of water, and ethyl alcohol (95 vol %) is added up to 1 L. The resulting solution is placed in an alkali-resistant container, so as to preclude contact with carbon dioxide and so forth, and is allowed to stand for 3 days, followed by filtration, to yield a potassium hydroxide solution. The obtained potassium hydroxide solution is stored in an alkali-resistant container. To work out the factor of the potassium hydroxide solution, 25 mL of 0.5 mol/L hydrochloric acid are placed in an Erlenmeyer flask, several drops of the phenolphthalein solution are added, and titration is carried out using the above potassium hydroxide solution, the factor being then worked out on the basis of the amount of the potassium hydroxide solution necessary for neutralization. Hydrochloric acid produced in accordance with JIS-K 8001-1998 is used as the above 0.5 mol/L hydrochloric acid.

(2) Operation (A) Main Test

Herein 1.0 g of pulverized sample is weighed exactly in a 200 mL round bottom flask, and 5.0 mL of the acetylation reagent are accurately added thereto, using a whole pipette. If the sample proves herein difficult to dissolve in the acetylation reagent, a small amount of special-grade toluene is added to dissolve the sample.

A small funnel is placed on the mouth of the flask, and about 1 cm of the bottom of the flask is heated by being immersed in a glycerin bath at about 97° C. In order to prevent the temperature of the neck of the flask from rising by absorbing heat from the bath, it is preferable to cover the base of the neck of the flask with heavy paper having a round hole opened therein.

After 1 hour the flask is removed from the glycerin bath and is allowed to cool down. After cool-down, 1 mL of water is added through the funnel, with shaking to elicit hydrolysis of acetic anhydride. The flask is heated again in the glycerin bath for 10 minutes, for the purpose of completing hydrolysis. After cool-down, the funnel and flask walls are washed with 5 mL of ethyl alcohol.

A few drops of the phenolphthalein solution are added next as an indicator, and titration is performed using the above potassium hydroxide solution. The end point of the titration occurs when the light red color of the indicator persists for about 30 seconds.

(B) Blank Test

Titration is performed in the same manner as described above except that herein no sample is used.

(3) The hydroxyl value is then calculated by plugging the obtained results into the expression below.

$$A=[\{(B-C)\times 28.05\times f\}/S]+D$$

In the expression, A: hydroxyl value (mgKOH/g) B: addition amount (mL) of the potassium hydroxide solution in the blank test, C: addition amount (mL) of the potassium hydroxide solution in the main test, f: factor of the potassium hydroxide solution, S: mass (g) of the sample, and D: acid value (mgKOH/g) of the sample.

Method for Measuring Melting Point

The melting point of the polymer A and the wax are measured under the conditions below, using DSC Q1000 (by TA Instruments Inc.).

Ramp rate: 10° C./min

Measurement start temperature: 20° C.

Measurement end temperature: 180° C.

The melting points of indium and zinc are used for temperature correction in the detection unit of the device, and the heat of fusion of indium is used for correcting the amount of heat.

Specifically, 5 mg of a sample are weighed exactly, are placed in an aluminum pan, and a differential scanning calorimetric measurement is performed. An empty pan made of silver is used as a reference.

The peak temperature of a maximum endothermic peak in a first temperature rise process is taken as the melting point (units: ° C.).

In a case where there is a plurality of maximum endothermic peaks, the largest peak is taken as the endothermic quantity.

Method for Measuring Softening Point of Resins

The softening point of a given resin is measured herein using a capillary rheometer of constant-load extrusion type, "Flowtester CFT-500D" (by Shimadzu Corporation), according to the manual ancillary to the device. In this device, the temperature of a measurement sample packed into a cylinder is raised to inch the sample, while under application of a constant load, from the top of the measurement sample, by means of a piston, the melted measurement sample being then extruded from a die at the bottom of the cylinder, such that a flow curve can be obtained that denotes a relationship between the piston downstroke at this time and temperature.

The softening point is herein the "melting temperature in the 1:2 method" set forth in the manual ancillary to the "Flow characteristic evaluation device Flowtester CFT-500D". The melting temperature in the ½ method is calculated as follows.

Firstly, ½ of the difference between the piston downstroke at the completion of outflow (outflow completion point, herein Smax) and the piston downstroke at the start of outflow (lowest point, herein Smin) is worked out (this value is designated as X; herein, X=(Smax−Smin)/2). The temperature in the flow curve at a time where the piston downstroke reaches the sum of X and Smin yields the melting temperature by the ½ method.

The measurement sample that is used has a cylindrical shape with a diameter of about 8 mm and is obtained by subjecting about 1.0 g of resin to compressive forming for about 60 seconds at about 10 MPa in an environment at 25° C., using a tablet compression molder (Standard Manual Newton Press NT-100H, by NPa System Co., Ltd.).

The specific measurement operation follows the procedure in the manual ancillary to the device.

The measurement conditions of CFT-500D are as follows.

Test mode: temperature ramp

Starting temperature: 50° C.

Saturated temperature: 200° C.

Measurement interval: 1.0° C.

Ramp rate: 4.0° C./min

Piston cross-sectional area: 1.000 $cm^2$

Test load (piston load): 10.0 kgf (0.9807 MPa)

Preheating time: 300 seconds

Die hole diameter: 1.0 mm

Die length: 1.0 mm

EXAMPLES

The present disclosure will be explained in further detail hereafter by way of examples. However, these examples are not meant to limit the present disclosure in any way. Unless otherwise stated, the language "parts" in the formulations below refers to parts by mass in all instances.

Production Example of Polymer A1

Solvent: toluene 100.0 parts

Monomer composition 100.0 parts (The monomer composition denotes a mixture of the behenyl acrylate/acrylonitrile/styrene below, in the proportions given below.)

Behenyl acrylate (first polymerizable monomer) 67.0 parts (25.3 mol %)

Acrylonitrile (second polymerizable monomer) 22.0 parts (59.5 mol %)

Styrene (third polymerizable monomer) 11.0 parts (15.2 mol %)

Polymerization initiator: 0.5 parts

[t-butyl peroxypivalate (Perbutyl PV, by NOF Corporation)]

The above materials were charged, under a nitrogen atmosphere, into a reaction vessel equipped with a reflux condenser, a stirrer, a thermometer and a nitrogen introduction tube. A polymerization reaction was carried out for 12 hours, through heating at 70° C. while the interior of reaction vessel was stirred at 200 rpm, to obtain a solution in which a polymer of the monomer composition was dissolved in toluene.

Subsequently, the temperature of the solution was lowered to 25° C. and then the solution was added to 1000.0 parts of methanol, while under stirring, to elicit precipitation of a methanol-insoluble fraction.

The obtained methanol-insoluble fraction was filtered off, was further washed with methanol, and was thereafter vacuum-dried at 40° C. for 24 hours, to yield Polymer A1.

Polymer A1 had a weight-average molecular weight (Mw) of 30000, a melting point (Tp) of 62° C. and an acid value of 0.0 mgKOH/g.

Polymer A1 was analyzed by NMR; the results of monomer unit content yielded 25.3 mol % of monomer units derived from behenyl acrylate, 59.5 mol % of monomer units derived from acrylonitrile and 15.2 mol % of monomer units derived from styrene. The SP values (units: $(J/cm^3)^{0.5}$) of the monomer units derived from the polymerizable monomers and of the polymer A were calculated in accordance with the above method.

Preparation of Monomer Having Urethane Group

Herein 50.0 parts of methanol were charged into a reaction vessel. Thereafter, 5.0 parts of KarenzMOI (2-isocyanatoethyl methacrylate) (by Showa Denko KK) were dropped under stirring, at 40° C. Once dropping was over, the whole was stirred for 2 hours while the temperature was maintained at 40° C. Unreacted methanol was removed thereafter in an evaporator, to thereby prepare a monomer having a urethane group.

Production Example of Polymers A2 to A21

Polymer A2 to Polymer A21 were obtained by conducting a reaction similarly to the production example of Polymer A1, except that herein the polymerizable monomers and number of parts thereof were modified as given in Table 1. Table 2 and Table 3 illustrate the physical properties of Polymer A1 to Polymer A21.

TABLE 1

| Polymer A | First polymerizable monomer Type | Parts | mol [%] | Second polymerizable monomer Type | Parts | mol [%] | Third polymerizable monomer Type | Parts | mol [%] |
|---|---|---|---|---|---|---|---|---|---|
| 1 | BEA | 67.0 | 25.3 | AN | 22.0 | 59.5 | St | 11.0 | 15.2 |
| 2 | BEA | 76.0 | 30.6 | AN | 24.0 | 69.4 | — | — | — |
| 3 | BEA | 40.0 | 17.9 | HEMA | 49.0 | 64.1 | St | 11.0 | 18.0 |
| 4 | BEA | 26.0 | 13.4 | UT | 63.0 | 65.8 | St | 11.0 | 20.8 |
| 5 | BEA | 84.0 | 52.5 | AN | 5.0 | 22.4 | St | 11.0 | 25.1 |
| 6 | BEA | 85.0 | 55.2 | AN | 4.0 | 18.6 | St | 11.0 | 26.1 |
| 7 | BEA | 20.0 | 5.4 | VA | 75.0 | 89.7 | St | 5.0 | 4.9 |
| 8 | BEA | 19.0 | 5.1 | VA | 77.0 | 91.0 | St | 4.0 | 3.9 |
| 9 | BEA | 85.0 | 58.5 | VA | 7.0 | 21.3 | St | 8.0 | 20.1 |
| 10 | BEA | 37.0 | 8.2 | AN | 52.0 | 82.9 | St | 11.0 | 8.9 |
| 11 | BEA | 40.0 | 9.3 | AN | 49.0 | 81.4 | St | 11.0 | 9.3 |
| 12 | BEA | 74.0 | 33.9 | AN | 14.0 | 46.0 | St | 12.0 | 20.1 |
| 13 | BEA | 19.0 | 5.2 | VA | 70.0 | 83.9 | St | 11.0 | 10.9 |
| 14 | BEA | 18.0 | 5.0 | VA | 47.0 | 58.1 | St | 10.0 | 10.2 |
| | | | | | | | MMA | 25.0 | 26.6 |
| 15 | BEA | 91.0 | 59.9 | AN | 8.0 | 37.7 | St | 1.0 | 2.4 |
| 16 | STA | 67.0 | 28.4 | AN | 22.0 | 57.1 | St | 11.0 | 14.5 |
| 17 | MYA | 67.0 | 20.7 | AN | 22.0 | 63.2 | St | 11.0 | 16.1 |
| 18 | BEA | 19.0 | 5.8 | — | — | — | St | 11.0 | 12.4 |
| | | | | | | | MMA | 70.0 | 81.8 |
| 19 | BEA | 17.0 | 4.7 | VA | 47.0 | 57.7 | St | 10.0 | 10.1 |
| | | | | | | | MMA | 26.0 | 27.4 |
| 20 | BEA | 92.0 | 63.1 | AN | 7.0 | 34.4 | St | 1.0 | 2.5 |
| 21 | HA | 67.0 | 30.3 | AN | 22.0 | 55.6 | St | 11.0 | 14.2 |

The abbreviations in Table 1 to Table 3 are as follows.

BEA: behenyl acrylate

STA: stearyl acrylate

MYA: Myricyl acrylate

HA: hexadecyl acrylate

AN: acrylonitrile

HEMA: 2-hydroxyethyl methacrylate

UT: Monomer having a urethane group

VA: vinyl acetate

St: styrene

MM: methyl methacrylate

TABLE 2

| Polymer A | Monomer unit derived from first polymerizable monomer Unit | $SP_{A11}$ | Monomer unit derived from second polymerizable monomer Unit | $SP_{A21}$ | Monomer unit derived from third polymerizable monomer Unit | $SP_{A31}$ | $SP_A$ |
|---|---|---|---|---|---|---|---|
| 1 | BEA | 18.25 | AN | 29.43 | St | 20.11 | 20.7 |
| 2 | BEA | 18.25 | AN | 29.43 | — | — | 20.7 |
| 3 | BEA | 18.25 | HEMA | 25.49 | St | 20.11 | 20.7 |
| 4 | BEA | 18.25 | UT | 23.79 | St | 20.11 | 20.7 |
| 5 | BEA | 18.25 | AN | 29.43 | St | 20.11 | 19.0 |
| 6 | BEA | 18.25 | AN | 29.43 | St | 20.11 | 18.9 |
| 7 | BEA | 18.25 | VA | 21.60 | St | 20.11 | 20.7 |
| 8 | BEA | 18.25 | VA | 21.60 | St | 20.11 | 20.8 |
| 9 | BEA | 18.25 | VA | 21.60 | St | 20.11 | 18.6 |
| 10 | BEA | 18.25 | AN | 29.43 | St | 20.11 | 23.9 |
| 11 | BEA | 18.25 | AN | 29.43 | St | 20.11 | 24.1 |
| 12 | BEA | 18.25 | AN | 29.43 | St | 20.11 | 19.9 |
| 13 | BEA | 18.25 | VA | 21.60 | St | 20.11 | 20.7 |
| 14 | BEA | 18.25 | VA | 21.60 | St | 20.11 | 20.4 |
| | | | | | MMA | 20.31 | |
| 15 | BEA | 18.25 | AN | 29.43 | St | 20.11 | 19.1 |
| 16 | STA | 18.39 | AN | 29.43 | St | 20.11 | 20.8 |
| 17 | MYA | 18.08 | AN | 29.43 | St | 20.11 | 20.6 |
| 18 | BEA | 18.25 | — | — | St | 20.11 | 19.9 |
| | | | | | MMA | 20.31 | |
| 19 | BEA | 18.25 | VA | 21.60 | St | 20.11 | 20.4 |
| | | | | | MMA | 20.31 | |

TABLE 2-continued

| Polymer | Monomer unit derived from first polymerizable monomer | | Monomer unit derived from second polymerizable monomer | | Monomer unit derived from third polymerizable monomer | | |
|---|---|---|---|---|---|---|---|
| A | Unit | $SP_{A11}$ | Unit | $SP_{A21}$ | Unit | $SP_{A31}$ | $SP_A$ |
| 20 | BEA | 18.25 | AN | 29.43 | St | 20.11 | 19.0 |
| 21 | HA | 18.47 | AN | 29.43 | St | 20.11 | 20.3 |

The units of SP value in the table are $(J/cm^3)^{0.5}$.

TABLE 3

| Polymer A | Weight average molecular weight (Mw) | Melting point Tp [° C.] | Acid value AV [mgKOH/g] |
|---|---|---|---|
| 1 | 30000 | 62 | 0.0 |
| 2 | 31000 | 62 | 0.0 |
| 3 | 32000 | 61 | 0.0 |
| 4 | 33000 | 60 | 0.0 |
| 5 | 29000 | 63 | 0.0 |
| 6 | 28000 | 64 | 0.0 |
| 7 | 32000 | 61 | 0.0 |
| 8 | 33000 | 60 | 0.0 |
| 9 | 28000 | 64 | 0.0 |
| 10 | 32000 | 61 | 0.0 |
| 11 | 32000 | 61 | 0.0 |
| 12 | 30000 | 62 | 0.0 |
| 13 | 32000 | 61 | 0.0 |
| 14 | 32000 | 61 | 0.0 |
| 15 | 28000 | 64 | 0.0 |
| 16 | 30000 | 60 | 0.0 |
| 17 | 28000 | 64 | 0.0 |
| 18 | 32000 | 59 | 0.0 |
| 19 | 31000 | 59 | 0.0 |
| 20 | 28000 | 65 | 0.0 |
| 21 | 32000 | 59 | 0.0 |

Production Example of Component B1

| | |
|---|---|
| Solvent: toluene | 100.0 parts |
| Monomer composition | 100.0 parts |

(The monomer composition is a mixture of the polyethylene/acrylonitrile/butyl acrylate/styrene below, in the proportions given below).

| | |
|---|---|
| Polyethylene | 10.0 parts (1.2 mol %) |
| Acrylonitrile | 40.0 parts (60.8 mol %) |
| Butyl acrylate | 5.0 parts (3.1 mol %) |
| Styrene | 45.0 parts (34.9 mol %) |
| Polymerization initiator: | 0.5 parts |

[t-butyl peroxypivalate (Perbutyl PV, by NOF Corporation)]

The above materials were charged, under a nitrogen atmosphere, into a reaction vessel equipped with a reflux condenser, a stiffer, a thermometer and a nitrogen introduction tube. A polymerization reaction was carried out for 12 hours, through heating at 70° C. while the interior of reaction vessel was stirred at 200 rpm, to obtain a solution in which a polymer of the monomer composition was dissolved in toluene.

Subsequently, the temperature of the solution was lowered to 25° C. and then the solution was added to 1000.0 parts of methanol, while under stirring, to elicit precipitation of a methanol-insoluble fraction.

The obtained methanol-insoluble fraction was separated by filtration, was further washed with methanol, and was thereafter vacuum-dried at 40° C. for 24 hours, to yield Component BR. The weight-average molecular weight of Component B1 was 20000.

Component B1 above was analyzed by NMR; the results of monomer unit content yielded 1.2 mol % of monomer units derived from polyethylene, 60.8 mol % of monomer units derived from acrylonitrile, 3.1 mol % of monomer units derived from butyl acrylate and 34.9 mol % of monomer units derived from styrene. The SP values (units: $(J/cm^3)^{0.5}$) of the monomer units derived from the polymerizable monomers and of the component B were calculated in accordance with the above method.

Production Examples of Component B2 to Component B10

Component B2 to Component B10 were obtained by conducting a reaction similarly to the production example of Component B1, except that herein the polymerizable monomers and number of parts thereof were modified as given in Table 4. Table 5 sets out the physical properties of Component B1 to Component B10.

TABLE 4

| Component B | Polymerizable monomer 1 | | | Polymerizable monomer 2 | | | Polymerizable monomer 3 | | | Polymerizable monomer 4 | | |
|---|---|---|---|---|---|---|---|---|---|---|---|---|
| | Type | Parts | mol [%] | Type | Parts | mol [%] | Type | Parts | mol [%] | Type | Parts | mol [%] |
| 1 | PE | 10.0 | 1.2 | AN | 40.0 | 60.8 | BA | 5.0 | 3.1 | St | 45.0 | 34.9 |
| 2 | HD | 33.0 | 45.7 | SA | 67.0 | 54.3 | — | — | — | — | — | — |
| 3 | PE | 10.0 | 1.6 | AN | 3.0 | 6.3 | BA | 5.0 | 4.3 | St | 45.0 | 34.9 |
| 4 | PE | 22.0 | 4.2 | AN | 1.0 | 2.4 | BA | 5.0 | 5.0 | St | 72.0 | 88.4 |
| 5 | PE | 2.0 | 0.2 | AN | 97.0 | 99.3 | — | — | — | St | 1.0 | 0.5 |
| 6 | PE | 10.0 | 1.4 | AN | 28.0 | 48.3 | BA | 25.0 | 17.8 | St | 37.0 | 32.5 |
| 7 | PE | 10.0 | 1.1 | AN | 46.0 | 66.9 | BA | 5.0 | 3.0 | St | 39.0 | 28.9 |
| 8 | PE | 10.0 | 1.1 | AN | 47.0 | 67.9 | BA | 5.0 | 3.0 | St | 38.0 | 28.0 |
| 9 | PE | 10.0 | 1.3 | AN | 27.0 | 45.4 | BA | 5.0 | 3.5 | St | 58.0 | 49.7 |

The abbreviations in Table 4 and Table 5 are as follows.

PE: polyethylene

AN: acrylonitrile

BA: butyl acrylate

St: styrene

HD: hexanediol

SA: sebacic acid

TABLE 5

| Component | Monomer unit derived from first polymerizable monomer | | Monomer unit derived from second polymerizable monomer | | Monomer unit derived from third polymerizable monomer | | Monomer unit derived from fourth polymerizable monomer | | | Weight-average molecular weight |
|---|---|---|---|---|---|---|---|---|---|---|
| B | Unit | $SP_{B11}$ | Unit | $SP_{B21}$ | Unit | $SP_{B31}$ | Unit | $SP_{B41}$ | $SP_B$ | (Mw) |
| 1 | PE | 18.25 | AN | 29.43 | BA | 19.98 | St | 20.11 | 23.2 | 20000 |
| 2 | HD | 24.45 | SA | 22.58 | — | — | — | — | 23.3 | 28000 |
| 3 | PE | 18.25 | AN | 29.43 | BA | 19.98 | St | 20.11 | 20.0 | 25000 |
| 4 | PE | 18.25 | AN | 29.43 | BA | 19.98 | St | 20.11 | 19.5 | 23000 |
| 5 | PE | 18.25 | AN | 29.43 | — | — | St | 20.11 | 29.0 | 15000 |
| 6 | PE | 18.25 | AN | 29.43 | BA | 19.98 | St | 20.11 | 22.2 | 19000 |
| 7 | PE | 18.25 | AN | 29.43 | BA | 19.98 | St | 20.11 | 23.8 | 18000 |
| 8 | PE | 18.25 | AN | 29.43 | BA | 19.98 | St | 20.11 | 23.9 | 18000 |
| 9 | PE | 18.25 | AN | 29.43 | BA | 19.98 | St | 20.11 | 22.1 | 22000 |

The units of SP value in the table are $(J/cm^3)^{0.5}$.

Production Example of Amorphous Polyester Resin P1

Bisphenol A/propylene oxide adduct (average number of added moles 2.0): 37.0 parts (13.6 mol %)

Ethylene glycol: 13.0 parts (35.5 mol %)

Terephthalic acid: 50.0 parts (50.9 mol %)

Titanium tetrabutoxide (esteritication catalyst): 0.5 parts

The above materials were weighed in reaction vessel equipped with a cooling tube, a stirrer, a nitrogen introduction tube and a thermocouple.

Next, the interior of the of the reaction vessel was purged with nitrogen gas, after which the temperature was raised gradually while under stirring, and the reaction was conducted for 2 hours, while under stirring, at a temperature of 200° C.

Then pressure in the reaction vessel was lowered to 8.3 kPa, and the reaction was conducted for 5 hours with the temperature kept at 200° C.; once the softening point was confirmed to have reached a temperature of 100° C., the temperature was lowered to stop the reaction, and yield Amorphous polyester resin P1.

The weight-average molecular weight (Mw) of the obtained Amorphous polyester resin P1 was 12000.

The above Amorphous polyester resin P1 was analyzed by NMR: the results of monomer unit content yielded 13.6 mol % of monomer units derived from polyoxypropylene(2.0)-2,2-bis(4-hydroxyphenyl) propane, 35.5 mol % of monomer units derived from ethylene glycol and 50.9 mol % of monomer units derived from terephthalic acid. The SP values (units: $(J/cm^3)^{0.5}$) of the monomer units derived from the polymerizable monomers and of the amorphous polyester resin were calculated in accordance with the above method.

Production Example of Amorphous Polyester Resin P2 to Amorphous Polyester Resin P10

Amorphous polyester resin P2 to Amorphous polyester resin P10 were obtained by conducting a reaction similarly to the production example of Amorphous polyester resin P1, except that herein the polymerizable monomers and number of parts thereof were modified as given in Table 6. Table 7 and Table 8 set out the physical properties of Amorphous polyester resin P2 to Amorphous polyester resin P10.

TABLE 6

| Amorphous | Polymerizable monomer 1 | | | Polymerizable monomer 2 | | | Polymerizable monomer 3 | | | Polymerizable monomer 4 | | |
|---|---|---|---|---|---|---|---|---|---|---|---|---|
| polyester resin P | Type | Parts | mol [%] | Type | Parts | mol [%] | Type | Parts | mol [%] | Type | Parts | mol [%] |
| 1 | PO2 | 37.0 | 13.6 | ED | 13.0 | 35.5 | TPA | 50.0 | 50.9 | — | — | — |
| 2 | PO2 | 79.0 | 55.1 | — | — | — | TPA | 5.0 | 9.7 | AA | 16.0 | 35.2 |
| 3 | PO3 | 82.0 | 53.6 | — | — | — | — | — | — | AA | 18.0 | 46.4 |
| 4 | — | — | — | THM | 27.0 | 49.5 | TMA | 73.0 | 50.5 | — | — | — |
| 5 | PO2 | 36.0 | 12.9 | ED | 14.0 | 37.3 | TPA | 50.0 | 49.8 | — | — | — |
| 6 | PO2 | 66.0 | 36.9 | ED | 4.0 | 16.6 | TPA | 30.0 | 46.5 | — | — | — |
| 7 | PO2 | 67.0 | 38.9 | ED | 3.0 | 12.9 | TPA | 30.0 | 48.2 | — | — | — |
| 8 | PO2 | 44.0 | 17.6 | ED | 11.0 | 32.6 | TPA | 45.0 | 49.8 | — | — | — |
| 9 | PO2 | 45.0 | 18.4 | ED | 10.0 | 30.4 | TPA | 45.0 | 51.1 | — | — | — |
| 10 | PO2 | 55.0 | 25.4 | ED | 8.0 | 27.4 | TPA | 37.0 | 47.3 | — | — | — |

The abbreviations in Table 6 and Table 7 are as follows.

PO2: bisphenol A/propylene oxide adduct (average number of added moles: 2.0)

PO3: bisphenol A/propylene oxide adduct (average number of added moles: 3.0)

ED: ethylene glycol

THM: pentaerythritol
TPA: terephthalic acid
TMA: trimellitic anhydride
AA: adipic acid

TABLE 7

| Amorphous polyester resin | Monomer unit derived from first polymerizable monomer | | Monomer unit derived from second polymerizable monomer | | Monomer unit derived from third polymerizable monomer | | Monomer unit derived from fourth polymerizable monomer | | Physical properties | | | |
|---|---|---|---|---|---|---|---|---|---|---|---|---|
| P | Unit | $SP_{P11}$ | Unit | $SP_{P21}$ | Unit | $SP_{P31}$ | Unit | $SP_{P41}$ | $SP_P$ | Weight-average molecular weight (Mw) | Acid value | Hydroxyl value |
| 1 | PO2 | 21.47 | ED | 30.33 | TPA | 26.52 | — | — | 25.2 | 12000 | 10 | 30 |
| 2 | PO2 | 21.47 | — | — | TPA | 26.52 | AA | 24.85 | 22.2 | 11000 | 15 | 30 |
| 3 | PO3 | 20.94 | — | — | — | — | AA | 24.85 | 21.6 | 10000 | 15 | 30 |
| 4 | — | — | THM | 33.42 | TMA | 31.01 | — | — | 31.8 | 9000 | 20 | 50 |
| 5 | PO2 | 21.47 | ED | 30.33 | TPA | 26.52 | — | — | 25.3 | 13000 | 8 | 25 |
| 6 | PO2 | 21.47 | ED | 30.33 | TPA | 26.52 | — | — | 23.3 | 11500 | 12 | 33 |
| 7 | PO2 | 21.47 | ED | 30.33 | TPA | 26.52 | — | — | 23.2 | 11500 | 12 | 33 |
| 8 | PO2 | 21.47 | ED | 30.33 | TPA | 26.52 | — | — | 24.8 | 12000 | 15 | 20 |
| 9 | PO2 | 21.47 | ED | 30.33 | TPA | 26.52 | — | — | 24.7 | 12000 | 15 | 20 |
| 10 | PO2 | 21.47 | ED | 30.33 | TPA | 26.52 | — | — | 24.1 | 11500 | 12 | 33 |

In the table, the units of SP value are $(J/cm^3)^{0.5}$ and the unit of acid value and hydroxyl value are mgKOH/g.

Production Example of Toner 1

Amorphous polyester resin P1: 90.00 parts
Polymer A1: 5.00 parts
Component B1:5.00 parts
Fischer-Tropsch wax (peak temperature of 90° C. of maximum endothermic peak): 5.00 parts
Colorant (carbon black): 10.00 parts The above materials were mixed using a Henschel mixer (FM-75 model, by Mitsui Mining Co., Ltd.) at a rotational speed of 1500 rpm and for a rotation time of 5 min, followed by kneading using a twin-screw kneader (PCM-30 model, by Ikegai Corp.), set to a temperature of 130° C.

The obtained kneaded product was cooled and was coarsely pulverized with a hammer mill, to a size of not more than 1 mm, to yield a coarsely pulverized product.

The obtained coarsely pulverized product was then finely pulverized using a mechanical pulverizer (T-250, by Turbo Kogyo Co., Ltd.). The resulting product was classified using Faculty (F-300, by Hosokawa Micron Corporation), to yield Toner particle 1. The operating conditions were set to a rotational speed of 11000 rpm of a classification rotor, and a rotational speed of 7200 rpm of a distribution rotor.

Toner particle: 100.0 parts
Silica fine particles: 4.0 parts
[Fumed silica surface-treated with hexamethyldisilazane (number-basis median diameter (D50) of 120 nm)]
Small-diameter inorganic fine particles: 1.0 part
[Titanium oxide fine particles surface-treated with isobutyltrimethoxysilanc (number-basis median diameter (D50) of 10 nm)]

The above materials were mixed using a Henschel mixer (FM-75 model, by Mitsui Miike Engineering Corporation) at a rotational speed of 1900 rpm and for a rotation time of 10 min, to yield Toner 1.

Toner 1 had $[(SP_P-SP_A)-(SP_A-SP_W)]$ of 0.9, $(SP_P-SP_B)$ of 2.0, and $[(SP_A-SP_W)-(SP_B-SP_A)]$ of 1.1.

Production Example of Toners 2 to 37

Toners 2 to 37 were obtained by performing an operation similar to that of the production example of Toner 1, but herein the type and addition amount of polymer A, and the type and addition amount of the component B of the production example of Toner 1 were modified as given in Table 8. Table 8 sets out the physical properties of the obtained toners.

TABLE 8

| | Binder resin formulation | | | | | | Physical properties | | | | | |
|---|---|---|---|---|---|---|---|---|---|---|---|---|
| | Amorphous polyester resin P | | Polymer A | | Component B | | | | | | | |
| Toner | Type | Parts | Type | Parts | Type | Parts | $SP_P - SP_A$ | $SP_A - SP_W$ | Exp. (1) | $SP_B - SP_A$ | $SP_P - SP_B$ | Exp. (2) |
| 1 | 1 | 90.00 | 1 | 5.00 | 1 | 5.00 | 4.5 | 3.6 | 0.9 | 2.5 | 2.0 | 1.1 |
| 2 | 1 | 90.00 | 1 | 5.00 | 2 | 5.00 | 4.5 | 3.6 | 0.9 | 2.6 | 2.0 | 1.0 |
| 3 | 1 | 90.00 | 2 | 5.00 | 1 | 5.00 | 4.5 | 3.6 | 0.9 | 2.5 | 2.0 | 1.1 |
| 4 | 1 | 94.90 | 1 | 5.00 | 1 | 0.10 | 4.5 | 3.6 | 0.9 | 2.5 | 2.0 | 1.1 |
| 5 | 1 | 85.00 | 1 | 5.00 | 1 | 10.00 | 4.5 | 3.6 | 0.9 | 2.5 | 2.0 | 1.1 |
| 6 | 1 | 94.95 | 1 | 5.00 | 1 | 0.05 | 4.5 | 3.6 | 0.9 | 2.5 | 2.0 | 1.1 |
| 7 | 1 | 84.00 | 1 | 5.00 | 1 | 11.00 | 4.5 | 3.6 | 0.9 | 2.5 | 2.0 | 1.1 |
| 8 | 1 | 90.00 | 3 | 5.00 | 1 | 5.00 | 4.5 | 3.6 | 0.9 | 2.5 | 2.0 | 1.1 |
| 9 | 1 | 90.00 | 4 | 5.00 | 1 | 5.00 | 4.5 | 3.6 | 0.9 | 2.5 | 2.0 | 1.1 |
| 10 | 2 | 90.00 | 5 | 5.00 | 3 | 5.00 | 3.3 | 1.8 | 1.5 | 1.1 | 2.2 | 0.7 |
| 11 | 2 | 90.00 | 6 | 5.00 | 3 | 5.00 | 3.4 | 1.7 | 1.7 | 1.2 | 2.2 | 0.5 |

TABLE 8-continued

| | Binder resin formulation | | | | | | Physical properties | | | | | |
|---|---|---|---|---|---|---|---|---|---|---|---|---|
| | Amorphous polyester resin P | | Polymer A | | Component B | | | | | | | |
| Toner | Type | Parts | Type | Parts | Type | Parts | $SP_P - SP_A$ | $SP_A - SP_W$ | Exp. (1) | $SP_B - SP_A$ | $SP_P - SP_B$ | Exp. (2) |
| 12 | 1 | 90.00 | 7 | 5.00 | 1 | 5.00 | 4.5 | 3.6 | 0.9 | 2.5 | 2.0 | 1.1 |
| 13 | 1 | 90.00 | 8 | 5.00 | 1 | 5.00 | 4.5 | 3.7 | 0.8 | 2.5 | 2.0 | 1.2 |
| 14 | 3 | 90.00 | 9 | 5.00 | 4 | 5.00 | 3.1 | 1.5 | 1.6 | 0.9 | 2.2 | 0.6 |
| 15 | 4 | 90.00 | 10 | 5.00 | 5 | 5.00 | 7.9 | 6.8 | 1.1 | 5.1 | 2.8 | 1.7 |
| 16 | 4 | 90.00 | 11 | 5.00 | 5 | 5.00 | 7.7 | 7.0 | 0.7 | 4.9 | 2.8 | 2.1 |
| 17 | 1 | 90.00 | 12 | 5.00 | 6 | 5.00 | 5.3 | 2.8 | 2.5 | 2.3 | 3.0 | 0.5 |
| 18 | 5 | 90.00 | 12 | 5.00 | 6 | 5.00 | 5.4 | 2.8 | 2.6 | 2.3 | 3.1 | 0.5 |
| 19 | 6 | 90.00 | 12 | 5.00 | 6 | 5.00 | 3.4 | 2.8 | 0.6 | 2.3 | 1.1 | 0.5 |
| 20 | 7 | 90.00 | 12 | 5.00 | 6 | 5.00 | 3.3 | 2.8 | 0.5 | 2.3 | 1.0 | 0.5 |
| 21 | 1 | 90.00 | 1 | 5.00 | 7 | 5.00 | 4.5 | 3.6 | 0.9 | 3.1 | 1.5 | 0.5 |
| 22 | 8 | 90.00 | 1 | 5.00 | 1 | 5.00 | 4.1 | 3.6 | 0.5 | 2.5 | 1.6 | 1.1 |
| 23 | 1 | 90.00 | 13 | 5.00 | 1 | 5.00 | 4.6 | 3.5 | 1.1 | 2.6 | 2.0 | 0.9 |
| 24 | 1 | 94.90 | 1 | 0.10 | 1 | 5.00 | 4.5 | 3.6 | 0.9 | 2.5 | 2.0 | 1.1 |
| 25 | 1 | 85.00 | 1 | 10.00 | 1 | 5.00 | 4.5 | 3.6 | 0.9 | 2.5 | 2.0 | 1.1 |
| 26 | 1 | 90.00 | 14 | 5.00 | 1 | 5.00 | 4.8 | 3.3 | 1.5 | 2.8 | 2.0 | 0.5 |
| 27 | 2 | 90.00 | 15 | 5.00 | 3 | 5.00 | 3.2 | 2.0 | 1.2 | 0.9 | 2.2 | 1.1 |
| 28 | 1 | 90.00 | 16 | 5.00 | 1 | 5.00 | 4.4 | 3.7 | 0.7 | 2.4 | 2.0 | 1.3 |
| 29 | 1 | 90.00 | 17 | 5.00 | 1 | 5.00 | 4.7 | 3.5 | 1.2 | 2.7 | 2.0 | 0.8 |
| 30 | 1 | 90.00 | 1 | 5.00 | 8 | 5.00 | 4.5 | 3.6 | 0.9 | 3.2 | 1.4 | 0.4 |
| 31 | 9 | 90.00 | 1 | 5.00 | 1 | 5.00 | 4.0 | 3.6 | 0.4 | 2.5 | 1.4 | 1.1 |
| 32 | 10 | 90.00 | 18 | 5.00 | 9 | 5.00 | 4.2 | 2.8 | 1.4 | 2.2 | 2.0 | 0.6 |
| 33 | 1 | 94.91 | 1 | 0.09 | 1 | 5.00 | 4.5 | 3.6 | 0.9 | 2.5 | 2.0 | 1.1 |
| 34 | 1 | 84.00 | 1 | 11.00 | 1 | 5.00 | 4.5 | 3.6 | 0.9 | 2.5 | 2.0 | 1.1 |
| 35 | 1 | 90.00 | 19 | 5.00 | 1 | 5.00 | 4.8 | 3.3 | 1.5 | 2.8 | 2.0 | 0.5 |
| 36 | 2 | 90.00 | 20 | 5.00 | 3 | 5.00 | 3.3 | 1.9 | 1.4 | 1.0 | 2.2 | 0.9 |
| 37 | 1 | 90.00 | 21 | 5.00 | 1 | 5.00 | 5.0 | 3.2 | 1.8 | 3.0 | 2.0 | 0.2 |

In the table, Exp. (1) and Exp. (2) denote Expression (1) and Expression (2), respectively.

Production Example of Magnetic Carrier 1

Magnetite 1 (intensity of magnetization 65 $Am^2/kg$ in a 1000/4π (kA/m) magnetic field) having a number-average particle diameter of 0.30 μm Magnetite 2 (intensity of magnetization 65 $Am^2/kg$ in a 1000/4π (kA/m) magnetic field) having a number-average particle diameter of 0.50 μm Herein 4.0 parts of a silane compound (3-(2-aminoethylaminopropyl)trimethoxysilane) were added to 100 parts of each of the above materials, with high-speed mixing and stirring at at least 100° C. interior of the vessel, to treat the respective fine particles.

Phenol: 10 mass %

Formaldehyde solution: 6 mass %

(formaldehyde 40 mass %, methanol 10 mass %, water 50 mass %)

Magnetite 1 treated with the above silane compound: 58 mass %

Magnetite 2 treated with the above silane compound: 26 mass %

Then 100 parts of the above material, 5 parts of a 28 mass % aqueous ammonia solution, and 20 parts of water were charged into a flask, the temperature was raised to 85° C. over 30 minutes while under mixing by stirring, and a polymerization reaction was conducted by holding that temperature for 3 hours, to cure the generated phenolic resin.

The cured phenolic resin was then cooled down to 30° C., followed by further addition of water, after which the supernatant was removed, and the precipitate was washed with water and was subsequently air-dried.

Next, the resulting product was dried under reduced pressure (not more than 5 mmHg) at a temperature of 60° C., to yield a spherical Magnetic carrier 1 of magnetic body-dispersed type. The volume-basis 50% particle diameter (D50) of Magnetic carrier 1 was 34.2 μm.

Production Example of Two-Component Developer 1

Herein 8.0 parts of Toner 1 were added to 92.0 parts of Magnetic carrier 1, with mixing using a V-type mixer (V-20, by Seishin Enterprise Co., Ltd.), to obtain Two-component developer 1.

Production Example of Two-Component Developer 2 to Two-Component Developer 37

Two-component developer 2 to Two-component developer 37 were produced by performing the same operation is in the production example of Two-component developer 1, except for the modifications given in Table 9.

TABLE 9

| | Two-component developer | Toner | Magnetic carrier |
|---|---|---|---|
| Example 1 | 1 | 1 | 1 |
| Example 2 | 2 | 2 | 1 |
| Example 3 | 3 | 3 | 1 |
| Example 4 | 4 | 4 | 1 |
| Example 5 | 5 | 5 | 1 |
| Example 6 | 6 | 6 | 1 |
| Example 7 | 7 | 7 | 1 |
| Example 8 | 8 | 8 | 1 |
| Example 9 | 9 | 9 | 1 |

TABLE 9-continued

| | Two-component developer | Toner | Magnetic carrier |
|---|---|---|---|
| Example 10 | 10 | 10 | 1 |
| Example 11 | 11 | 11 | 1 |
| Example 12 | 12 | 12 | 1 |
| Example 13 | 13 | 13 | 1 |
| Example 14 | 14 | 14 | 1 |
| Example 15 | 15 | 15 | 1 |
| Example 16 | 16 | 16 | 1 |
| Example 17 | 17 | 17 | 1 |
| Example 18 | 18 | 18 | 1 |
| Example 19 | 19 | 19 | 1 |
| Example 20 | 20 | 20 | 1 |
| Example 21 | 21 | 21 | 1 |
| Example 22 | 22 | 22 | 1 |
| Example 23 | 23 | 23 | 1 |
| Example 24 | 24 | 24 | 1 |
| Example 25 | 25 | 25 | 1 |
| Example 26 | 26 | 26 | 1 |
| Example 27 | 27 | 27 | 1 |
| Example 28 | 28 | 28 | 1 |
| Example 29 | 29 | 29 | 1 |
| Comparative example 1 | 30 | 30 | 1 |
| Comparative example 2 | 31 | 31 | 1 |
| Comparative example 3 | 32 | 32 | 1 |
| Comparative example 4 | 33 | 33 | 1 |
| Comparative example 5 | 34 | 34 | 1 |
| Comparative example 6 | 35 | 35 | 1 |
| Comparative example 7 | 36 | 36 | 1 |
| Comparative example 8 | 37 | 37 | 1 |

Example 1

An evaluation was performed using the above Two-component developer 1.

Two-component developer 1 was introduced into a cyan developing device, using, as the image forming apparatus, a remodeled printer imageRUNNER ADVANCE C5560 for digital commercial printing, by Canon. The device was modified so as to allow freely setting the fixation temperature, process speed, DC voltage $V_{DC}$ of a developer carrier, charging voltage $V_D$ of an electrostatic latent image bearing member, and laser power. To evaluate image output, an FFh image (solid image) having a desired image ratio was outputted, and $V_{DC}$, $V_D$ and laser power were adjusted so that the amount of toner on the FFh image, on paper, was as desired. The below-described evaluation was then carried out.

Herein "FFh" denotes a value obtained by displaying 256 gradations in hexadecimal notation, with OOH as the first of the 256 gradations (white background portion) and FFh as the 256-th gradation (solid portion)

Evaluation is performed on the basis of the evaluation method below; the results are given in Table 10.

Abrasion Resistance

Paper: Image coat gloss 158 (158.0 g/m$^2$)

(sold by Canon Marketing Japan Inc.)

Amount of toner on paper: 0.05 mg/cm$^2$ (2Fh image)

(adjusted on the basis of the DC voltage $V_{DC}$ of the developer carrier, the charging voltage $V_D$ of the electrostatic latent image bearing member, and laser power)

Evaluation image: 3 cm×15 cm in the center of the above A4 paper

Fixation test environment: normal-temperature/normal humidity environment (temperature 23° C./humidity 50% RH (hereafter N/N))

Fixation temperature: 180° C.

Process speed: 377 mm/sec

The above evaluation image was output and abrasion resistance was evaluated. The value of the difference in reflectance was taken as an evaluation index of abrasion resistance.

Firstly, a Gakushin-type friction fastness tester (AB-301: by Tester Sangyo Co., Ltd.) is used to apply a load of 0.5 kgf to an image portion of the evaluation image, with rubbing (10 reciprocations) using a new evaluation paper. Thereafter the reflectance of the rubbed portion and the reflectance of the non-rubbed portion of the new evaluation paper are measured using a reflectometer (REFLECTOMETER MODEL TC-6DS: by Tokyo Denshoku Co., Ltd.).

The difference in reflectance before and after rubbing was calculated on the basis of the expression below. The difference in the obtained reflectance was evaluated according to the evaluation criteria below.

Reflectance difference=reflectance before rubbing−reflectance after rubbing

Evaluation Criteria

A: less than 1.0%

B: at least 1.0% and less than 2.0%

C: at least 2.0% and less than 4.0%

D: at least 4.0%

Low-Temperature Fixability

Paper: GFC-081 (81.0 g/m$^2$)

(sold by Canon Marketing Japan Inc.)

Amount of toner on paper: 0.50 mg/cm$^2$ (adjusted on the basis of the DC voltage $V_{DC}$ of the developer carrier, the charging voltage $V_D$ of the electrostatic latent image bearing member, and laser power)

Evaluation image: 2 cm×5 cm image in the center of the above A4 paper

Test environment: low-temperature low-humidity environment: temperature 15° C./humidity 10% RH (hereafter "UL").

Fixation temperature: 150° C.

Process speed: 377 mm/sec

The above evaluation image was outputted and low-temperature fixability was evaluated. The value of the rate of decrease in image density was taken as an evaluation index of low-temperature fixability.

To evaluate the rate of decrease in image density, image density at the center is measured firstly using an X-Rite color reflection densitometer (500 series: by X-Rite Inc.). Next, a load of 4.9 kPa (50 g/cm$^2$) is applied to the portion where the image density is measured, and the fixed image is rubbed (5 reciprocations) with lens-cleaning paper, whereupon image density is measured again.

The rate of decrease in image density before and after rubbing was calculated on the basis of the expression below. The rate of decrease of the obtained image density was evaluated in accordance with the evaluation criteria below.

Rate of decrease of image density=(image density before rubbing−image density after rubbing)/image density before rubbing×100

Evaluation Criteria

A: rate of decrease of image density lower than 3%

B: rate of decrease of image density of at least 3% and less than 5%

C: rate of decrease of image density of at least 5% and less than 8%

D: rate of decrease of image density of at least 8%

Charge Retention Range in High-Temperature/High-Humidity Environment

Paper: GFC-081 (81.0 g/m$^2$)

(Canon Marketing Japan Inc.)

Amount of toner on paper: 0.35 mg/cm$^2$ (adjusted on the basis of the DC voltage $V_{DC}$ of the developer carrier, the charging voltage $V_D$ of the electrostatic latent image bearing member, and laser power)

Evaluation image: 2 cm×5 cm image in the center of the above A4 paper

Fixation test environment: high-temperature/high-humidity environment: temperature 30° C./humidity 80% RH (hereafter "H/H")

Process speed: 377 mm/sec

The triboelectric charge of the toner was calculated by suction-collecting the toner on the electrostatic latent image carrier using a metal cylindrical tube and a cylindrical filter.

Specifically, the triboelectric charge quantity of toner on the electrostatic latent image bearing member was measured using a Faraday cage.

The Faraday cage herein is a coaxial double cylinder such that the inner cylinder and outer cylinder are insulated from each other. When a charged body having a charge amount of Q is placed in the inner cylinder, a state is brought about, on account of electrostatic induction, that is identical to that when a metal cylinder having a charge amount Q is present. This induced charge amount was measured using an electrometer (Keithley 6517A, by Keithley Instruments Inc.), and the quotient (Q/M) resulting from dividing the charge amount Q (mC) by the toner mass M (kg) in the inner cylinder was taken as the triboelectric charge quantity of the toner.

Triboelectric charge quantity of toner (mC/kg)=$Q/M$

Firstly, the above evaluation image was formed on the electrostatic latent image bearing member, the rotation of the electrostatic latent image bearing member was stopped prior to transfer of the evaluation image to the intermediate transfer member, and the toner on the electrostatic latent image bearing member was suctioned and collected by a metallic cylindrical tube and cylindrical filter, whereupon "initial Q/M" was measured.

Subsequently, the developing device was placed in an evaluation apparatus, in an "11/H" environment, and was allowed to stand, as it was, for 2 weeks, after which the same operation as that prior to being allowed to stand was carried out. The charge amount Q/M (mC/kg) per unit mass of the electrostatic latent image bearing member after standing was measured. Then a retention rate was calculated in the form of ("Q/M after standing"/"initial Q/M"×100), where "initial Q/M" denotes Q/M per unit mass of the electrostatic latent image bearing member prior to standing and "Q/M after standing" denotes Q/M per unit mass of the electrostatic latent image bearing member after standing, and the calculated retention rate was evaluated in accordance with the following criteria.

Evaluation Criteria

A: retention rate of at least 95%

B: retention rate of at least 90% and less than 95%

C: retention rate of at least 85% and less than 90%

D: retention rate lower than 85%

Examples 2 to 29, and Comparative Examples 1 to 8

Evaluations similar to those of the Example 1 were carried out but using herein Two-component developer 2 to Two-component developer 37. The evaluation results are given in Table 10.

TABLE 10

| | Two-comp dev. No. | Low-temperature fixability | | | | Abrasion resistance | | Charge retention | | | |
|---|---|---|---|---|---|---|---|---|---|---|---|
| | | Evaluation | Image density before rubbing | Image density after rubbing | Rate of decrease | Evaluation | Reflectance difference | Evaluation | Q/M Initial Q/M | Q/M after standing | Q/M Retention rate |
| Example 1 | 1 | A | 1.35 | 1.32 | 2% | A | 0.0% | A | 36 | 36 | 100% |
| Example 2 | 2 | A | 1.35 | 1.32 | 2% | B | 1.0% | A | 36 | 36 | 100% |
| Example 3 | 3 | A | 1.35 | 1.32 | 2% | B | 1.5% | A | 36 | 36 | 100% |
| Example 4 | 4 | B | 1.35 | 1.31 | 3% | A | 0.0% | A | 36 | 36 | 100% |
| Example 5 | 5 | A | 1.35 | 1.32 | 2% | B | 1.8% | A | 36 | 36 | 100% |
| Example 6 | 6 | C | 1.35 | 1.28 | 5% | A | 0.0% | A | 36 | 36 | 100% |
| Example 7 | 7 | A | 1.35 | 1.32 | 2% | C | 3.0% | A | 36 | 36 | 100% |
| Example 8 | 8 | A | 1.35 | 1.32 | 2% | B | 1.0% | A | 36 | 35 | 97% |
| Example 9 | 9 | A | 1.35 | 1.32 | 2% | B | 1.5% | B | 36 | 34 | 94% |
| Example 10 | 10 | A | 1.35 | 1.32 | 2% | B | 1.8% | B | 36 | 33 | 92% |
| Example 11 | 11 | A | 1.35 | 1.32 | 2% | C | 2.5% | C | 36 | 32 | 89% |
| Example 12 | 12 | B | 1.35 | 1.31 | 3% | A | 0.0% | A | 36 | 36 | 100% |
| Example 13 | 13 | C | 1.35 | 1.28 | 5% | A | 0.0% | A | 36 | 36 | 100% |
| Example 14 | 14 | A | 1.35 | 1.32 | 2% | B | 1.8% | B | 36 | 33 | 92% |
| Example 15 | 15 | B | 1.35 | 1.31 | 3% | A | 0.0% | A | 36 | 36 | 100% |
| Example 16 | 16 | C | 1.35 | 1.28 | 5% | A | 0.0% | A | 36 | 36 | 100% |
| Example 17 | 17 | A | 1.35 | 1.32 | 2% | B | 1.8% | A | 36 | 36 | 100% |
| Example 18 | 18 | A | 1.35 | 1.32 | 2% | C | 2.5% | A | 36 | 36 | 100% |
| Example 19 | 19 | A | 1.35 | 1.32 | 2% | B | 1.5% | B | 36 | 34 | 94% |
| Example 20 | 20 | A | 1.35 | 1.32 | 2% | C | 2.5% | C | 36 | 32 | 89% |
| Example 21 | 21 | A | 1.35 | 1.32 | 2% | B | 1.5% | C | 36 | 32 | 89% |
| Example 22 | 22 | A | 1.35 | 1.32 | 2% | C | 3.0% | A | 36 | 36 | 100% |
| Example 23 | 23 | A | 1.35 | 1.32 | 2% | C | 3.4% | C | 36 | 31 | 86% |
| Example 24 | 24 | C | 1.35 | 1.25 | 7% | A | 0.0% | A | 36 | 36 | 100% |
| Example 25 | 25 | A | 1.35 | 1.32 | 2% | C | 3.0% | A | 36 | 36 | 100% |
| Example 26 | 26 | C | 1.35 | 1.25 | 7% | A | 0.0% | A | 36 | 36 | 100% |
| Example 27 | 27 | A | 1.35 | 1.32 | 2% | C | 3.0% | A | 36 | 36 | 100% |
| Example 28 | 28 | A | 1.35 | 1.32 | 2% | B | 1.5% | C | 36 | 32 | 89% |
| Example 29 | 29 | C | 1.35 | 1.25 | 7% | A | 0.0% | A | 36 | 36 | 100% |

TABLE 10-continued

| | Two-comp dev. No. | Low-temperature fixability Evaluation | Image density before rubbing | Image density after rubbing | Rate of decrease | Abrasion resistance Evaluation | Reflectance difference | Charge retention Q/M Evaluation | Initial Q/M | after standing | Retention rate |
|---|---|---|---|---|---|---|---|---|---|---|---|
| Comparative example 1 | 30 | A | 1.35 | 1.32 | 2% | D | 4.0% | D | 36 | 30 | 83% |
| Comparative example 2 | 31 | A | 1.35 | 1.32 | 2% | D | 4.5% | A | 36 | 36 | 100% |
| Comparative example 3 | 32 | A | 1.35 | 1.32 | 2% | D | 5.0% | D | 36 | 29 | 81% |
| Comparative example 4 | 33 | D | 1.35 | 1.20 | 11% | A | 0.0% | A | 36 | 36 | 100% |
| Comparative example 5 | 34 | A | 1.35 | 1.32 | 2% | D | 4.0% | A | 36 | 36 | 100% |
| Comparative example 6 | 35 | D | 1.35 | 1.22 | 10% | A | 0.0% | A | 36 | 36 | 100% |
| Comparative example 7 | 36 | A | 1.35 | 1.32 | 2% | D | 4.7% | A | 36 | 36 | 100% |
| Comparative example 8 | 37 | A | 1.35 | 1.32 | 2% | C | 3.0% | D | 36 | 30 | 83% |

In the table, Two-comp, dev. No. denotes "Two-component developer Number".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-037666, filed Mar. 5, 2020, and Japanese Patent Application No. 2021-016866, filed Feb. 4, 2021 which are hereby incorporated by reference herein in their entirety.

What is claimed is:

1. A toner, comprising:

a toner particle that contains a binder resin and a wax;

the binder resin comprising an amorphous polyester resin, a polymer A, and a component B; and the polymer A having first monomer units represented by Formula (C) and second monomer units represented by Formulae (E)

(C)

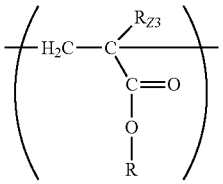

(E)

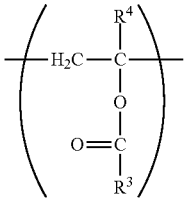

where $R_{Z3}$ represents a hydrogen atom,

R represents a C22 alkyl group, $R_3$ represents a C1 alkyl group, and $R_4$ represents a hydrogen atom, wherein a content of the amorphous polyester resin is at least 80.0 mass % with respect to a total mass of the binder resin, a content ratio of the first monomer units in the polymer A is 5.0 to 60.0 mol % with respect to a total number of moles of all monomer units in the polymer A, a content ratio of the second monomer unit in the polymer A is 20.0 to 90.0 mol % with respect to the total number of moles of all monomer units in the polymer A, $SP_{A21}$ $(J/cm^3)^{0.5}$ is at least 21.00 where $SP_{A21}$ is an SP value of the second monomer units, a content of the polymer A is 3.00 to 10.00 mass % with respect to the total mass of the binder resin, a content of the component B is 3.00 to 10.00 mass % with respect to the total mass of the binder resin, $$0.6 \leq [(SP_P - SP_A) - (SP_A - SP_W)] \leq 3.0 \text{ and}$$

$$0.6 \leq [(SP_A - SP_W) - (SP_B - SP_A)] \leq 2.5$$

when $SP_P$ $(J/cm^3)^{0.5}$ is an SP value of the amorphous polyester resin, $SP_A$ $(J/cm^3)^{0.5}$ is an SP value of the polymer A, $SP_B$ $(J/cm^3)^{0.5}$ is an SP value of the component B, and $SP_W$ $(J/cm^3)^{0.5}$ is an SP value of the wax, and a hydroxyl value of the amorphous polyester resin is 20 to 70 mgKOH/mg.

2. The toner according to claim 1, wherein $1.0 \leq (SP_P - SP_B) \leq 3.0$.

3. The toner according to claim 1, wherein $18.0 \leq SP_A \leq 24.0$ $(J/cm^3)^{0.5}$.

4. The toner according to claim 1, wherein the polymer A has third monomer units different from the first monomer units represented by the Formula (C) and the second monomer units, and the third monomer units are represented by Formula (F)

(F)

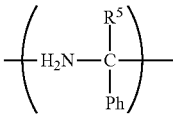

where $R^5$ represents a hydrogen atom or a methyl group, and Ph represents a phenyl group.

5. The toner according to claim 1, wherein the component B contains a graft polymer of a hydrocarbon compound and a styrene acrylic polymer.

6. The toner according to claim 1, wherein the component B contains a crystalline polyester resin.

7. The toner according to claim 1, wherein the content of the amorphous polyester resin is at least 85.0 mass % with respect to a total mass of the binder resin.

* * * * *